US009125452B2

(12) United States Patent
Curl et al.

(10) Patent No.: US 9,125,452 B2
(45) Date of Patent: Sep. 8, 2015

(54) CLEATS, CLEATED SOLE STRUCTURES, MOLDS, AND MOLDING METHODS FOR IN-MOLDING ARTICLES

(71) Applicant: NIKE, Inc., Beaverton, OR (US)

(72) Inventors: Darien Curl, Beaverton, OR (US); Dick Lin, Beaverton, OR (US); Nicole Mueller, Portland, OR (US); Ricardo Salinas, Jr., Hillsboro, OR (US); David Tu, Beaverton, OR (US)

(73) Assignee: NIKE, Incorporated, Beaverton, OR (US)

( * ) Notice: Subject to any disclaimer, the term of this patent is extended or adjusted under 35 U.S.C. 154(b) by 292 days.

(21) Appl. No.: 13/759,888

(22) Filed: Feb. 5, 2013

(65) Prior Publication Data

US 2014/0215862 A1 Aug. 7, 2014

(51) Int. Cl.

| | |
|---|---|
| ***A43C 15/16*** | (2006.01) |
| ***A43B 13/16*** | (2006.01) |
| ***A43B 13/26*** | (2006.01) |
| ***A43B 23/17*** | (2006.01) |
| ***A43C 1/00*** | (2006.01) |

(52) U.S. Cl.

CPC ..... *A43B 13/16* (2013.01); *A43B 13/26* (2013.01); *A43B 23/17* (2013.01); *A43C 1/00* (2013.01); *A43C 15/161* (2013.01); *A43C 15/162* (2013.01)

(58) Field of Classification Search

CPC ..... A43C 15/00; A43C 15/16; A43C 15/162; A43C 13/04

USPC ..... 36/67 R, 67 D, 134

See application file for complete search history.

(56) References Cited

U.S. PATENT DOCUMENTS

| | | | | |
|---|---|---|---|---|
| 1,617,418 A * | 2/1927 | Richardson | ..... | 36/59 R |
| 3,187,073 A | 6/1965 | Bingham, Jr. | | |
| 3,461,576 A | 8/1969 | Hubbard | | |
| 3,492,744 A * | 2/1970 | Bernier et al. | ..... | 36/59 R |
| 3,522,669 A | 8/1970 | Simons | | |

(Continued)

FOREIGN PATENT DOCUMENTS

| | | |
|---|---|---|
| EP | 0039268 A1 | 11/1981 |
| EP | 2420152 A2 | 2/2012 |

(Continued)

OTHER PUBLICATIONS

International Search Report and Written Opinion for PCT/US2014/014775 mailed Jun. 4, 2014.

(Continued)

*Primary Examiner* — Marie Bays

(74) *Attorney, Agent, or Firm* — Banner & Witcoff, Ltd.

(57) ABSTRACT

Cleat structures, e.g., for golf shoes, may include a flat and flexible interior surface and/or a generally disk-shaped perimeter area that includes features to promote in-molding of the cleat to a footwear sole component (e.g., to permanently engage the cleat with an outsole member). Such cleats may provide a flexible and comfortable base, including a low profile, e.g., to enable formation relatively thin and/or flexible footwear sole components. Footwear sole components and articles of footwear that include one or more in-molded cleat structures of this type also are described. Molds used for in-molding procedures and methods of using the molds to make articles with in-molded components (e.g., for making footwear sole structures including one or more in-molded cleats) also are described.

30 Claims, 13 Drawing Sheets

(56) References Cited

U.S. PATENT DOCUMENTS

| | | | | |
|---|---|---|---|---|
| 3,559,308 | A | 2/1971 | Bernier et al. | |
| 3,577,503 | A | 5/1971 | Innocenti | |
| 3,609,889 | A | 10/1971 | Calvin et al. | |
| 3,738,026 | A | 6/1973 | Granger | |
| 3,925,529 | A * | 12/1975 | Bernier et al. | 264/244 |
| 4,348,003 | A | 9/1982 | Beneteau | |
| 4,393,604 | A * | 7/1983 | Crowley | 36/67 R |
| 4,667,422 | A | 5/1987 | Yamaguchi | |
| 4,962,596 | A | 10/1990 | Dufour | |
| 4,984,377 | A * | 1/1991 | Schneider | 36/134 |
| 5,426,873 | A | 6/1995 | Savoie | |
| 5,657,556 | A | 8/1997 | Bemis | |
| 5,788,995 | A | 8/1998 | Brams et al. | |
| 5,979,083 | A | 11/1999 | Robinson et al. | |
| 5,987,784 | A | 11/1999 | Bignell | |
| 6,032,388 | A | 3/2000 | Fram | |
| 6,138,386 | A * | 10/2000 | Singer et al. | 36/127 |
| 6,381,878 | B1 * | 5/2002 | Kennedy et al. | 36/134 |
| 7,579,055 | B2 | 8/2009 | Lai et al. | |
| 7,726,047 | B1 * | 6/2010 | MacNeill et al. | 36/134 |
| 7,891,118 | B2 | 2/2011 | Chen et al. | |
| 7,905,034 | B2 | 3/2011 | Robinson, Jr. et al. | |
| 8,316,562 | B2 | 11/2012 | Locke et al. | |
| 2001/0011429 | A1 | 8/2001 | Peabody | |
| 2002/0078603 | A1 * | 6/2002 | Schmitt, Jr. | 36/134 |
| 2003/0029060 | A1 | 2/2003 | Hockerson et al. | |
| 2006/0059723 | A1 * | 3/2006 | Robinson et al. | 36/127 |
| 2006/0242863 | A1 * | 11/2006 | Patmore | 36/127 |
| 2007/0062070 | A1 | 3/2007 | Kuhtz et al. | |
| 2007/0101618 | A1 * | 5/2007 | Peake | 36/134 |
| 2007/0107262 | A1 | 5/2007 | Chang | |
| 2007/0240337 | A1 * | 10/2007 | Belluto | 36/134 |
| 2007/0277399 | A1 * | 12/2007 | Dow et al. | 36/134 |
| 2008/0072460 | A1 * | 3/2008 | Robinson et al. | 36/134 |
| 2009/0113765 | A1 | 5/2009 | Robinson, Jr. et al. | |
| 2009/0223088 | A1 * | 9/2009 | Krikorian et al. | 36/127 |
| 2009/0229147 | A1 | 9/2009 | McMullin | |
| 2009/0307933 | A1 | 12/2009 | Leach | |
| 2011/0146108 | A1 | 6/2011 | Grott et al. | |
| 2011/0167676 | A1 * | 7/2011 | Benz et al. | 36/134 |
| 2011/0232136 | A1 | 9/2011 | Curley | |
| 2012/0260535 | A1 | 10/2012 | Tsang | |
| 2012/0266490 | A1 | 10/2012 | Atwal et al. | |

FOREIGN PATENT DOCUMENTS

| | | | |
|---|---|---|---|
| EP | 2522241 | A1 | 11/2012 |
| FR | 2585618 | A1 | 2/1987 |
| JP | 5064601 | A | 3/1993 |
| JP | 5261002 | A | 10/1993 |

OTHER PUBLICATIONS

International Search Report and Written Opinion for PCT/US2014/014799 mailed May 22, 2014.

International Search Report and Written Opinion for PCT/US2014/014787 mailed May 27, 2014.

Office Action issued Feb. 27, 2015 in U.S. Appl. No. 13/759,893.

* cited by examiner

CLEATS, CLEATED SOLE STRUCTURES, MOLDS, AND MOLDING METHODS FOR IN-MOLDING ARTICLES

FIELD OF THE INVENTION

The present invention in part relates to the field of footwear. More specifically, some aspects of the present invention pertain to cleat structures, sole structures including such cleat structures, and articles of footwear (e.g., athletic footwear) that include such sole structures. Additional aspects of this invention relate to molds and methods of molding articles that may be used, for example, to produce articles with in-molded structures, including footwear sole structures with in-molded cleats.

BACKGROUND

Conventional golf shoes and other articles of footwear often include cleat structures or other traction enhancing elements to improve traction and provide a stable base for activities performed by the wearer. Many cleats of this type include a threaded connector or a turnbuckle type engagement structure to allow the cleat to be releasably engaged with a footwear sole structure. While useful to releasably engage the cleat with the shoe, such connector structures have certain disadvantages. For example, the treaded connector or turnbuckle type engagement structures typically extend toward the bottom (plantar) surface of the wearer's foot. Therefore, when the wearer stands and walks on the shoe, distinct high pressure points often can be felt underfoot, which lead to discomfort and/or fatigue, particularly after walking in the shoes for 18 or more holes of golf (often over terrain of varying slope and hardness).

Cushioning elements, rigid plates, or other pressure moderator or force dispersing structures may be incorporated into the footwear construction in an effort to reduce the point loading and/or pressure forces experienced by the wearer. Such structures, however, tend to increase the height of the shoe and/or reduce the flexibility and/or natural motion feel of the shoe. Many golfers find these features to be disadvantageous.

Additionally, the releasable connection between cleats and the sole structure may cause the cleat elements to loosen and become disengaged from the shoe, often without the wearer immediately knowing. Such unintended loss of cleats can adversely impact traction and potentially damage golf course mowing or maintenance equipment.

Accordingly, there is room in the art for improvements in cleated footwear structures, e.g., for golf shoes and/or other cleated footwear constructions.

SUMMARY OF THE INVENTION

This Summary is provided to introduce some general concepts relating to this invention in a simplified form that are further described below in the Detailed Description. This Summary is not intended to identify key features or essential features of the invention.

Some aspects of this invention relate to cleat structures, e.g., cleats for golf shoes or other cleated footwear. The cleat structures may include a flat interior surface and/or a generally disk-shaped perimeter area that includes structures to promote in-molding of the cleat to a footwear sole component. Such cleats may provide a flexible and comfortable base, e.g., to enable formation relatively thin and/or flexible footwear sole components.

Additional aspects of this invention relate to footwear sole components (e.g., outsole components) and/or articles of footwear that include one or more in-molded cleat structures, e.g., of the types described above. Still additional aspects of this invention relate to molds used for in-molding procedures and methods of using the molds to make articles with in-molded components (e.g., for making footwear sole structures including one or more in-molded cleats).

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
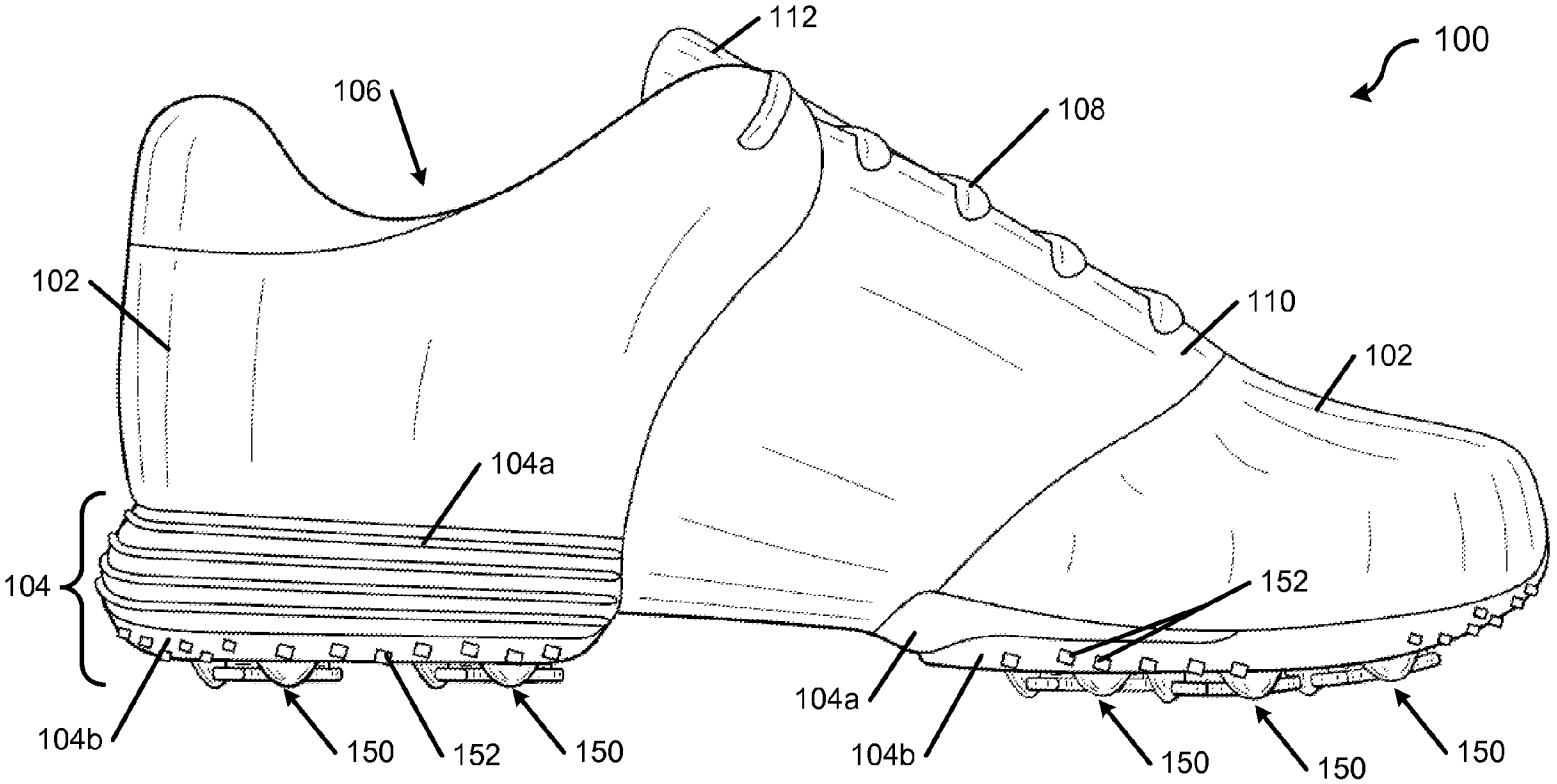
FIGS. 1A through 1D illustrate various views of cleat structures, sole structures, and articles of footwear according to examples of this invention.

In the following description of various examples of structures, components, and methods according to the present invention, reference is made to the accompanying drawings, which form a part hereof, and in which are shown by way of illustration various example structures, environments, and methods in which aspects of the invention may be practiced. It is to be understood that other structures, environments, and methods may be utilized and that structural and functional modifications may be made to the specifically described structures and methods without departing from the scope of the present invention.

I. General Description of Aspects of this Invention

As noted above, aspects of this invention relate to cleat structures, sole structures including cleat structures, and articles of footwear (e.g., athletic footwear) that include such sole structures. Additional aspects of this invention relate to molds and methods of molding articles that may be used, for example, to produce articles having in-molded structures or components, including footwear sole structures having in-molded cleats.

A. Cleat Constructions According to Aspects of this Invention

Some aspects of this invention relate to cleat constructions that can be incorporated into articles of footwear, such as athletic footwear (and in some specific examples, golf footwear). In some more specific examples, the cleats may be fixed or permanently incorporated into the sole structure of the article of footwear.

As a more specific example, cleats in accordance with at least some examples of this invention may include: (A) a cleat component made from a first material, wherein the cleat component includes: (i) a first leg having a first anchor post extending from a bottom side or underside of the first leg toward a bottom or base surface of the cleat component, (ii) a second leg having a second anchor post extending from a bottom side or underside of the second leg toward the bottom or base surface of the cleat component, and (iii) a third leg having a third anchor post extending from a bottom side or underside of the third leg toward the bottom or base surface of the cleat component; and (B) a cleat base engaged with the cleat component at the first, second, and third anchor posts, wherein the cleat base is made from a second material that is different from the first material. Two legs or more than three legs may be provided in some cleat structures without departing from this invention.

Another example of cleats in accordance with at least some aspects of this invention includes: (A) a cleat component made from a first material, wherein the cleat component includes: (i) a first leg, (ii) a second leg, (iii) a third leg, (iv) a first ridge extending between the first and second legs, (v) a second ridge extending between the second and third legs, and (vi) a third ridge extending between the first and third legs; and (B) a cleat base engaged with the cleat component such that a first portion of the cleat base at least partially surrounds the first ridge, a second portion of the cleat base at least partially surrounds the second ridge, and a third portion of the cleat base at least partially surrounds the third ridge, wherein the cleat base is made from a second material that is different from the first material. Other numbers of legs and/or intermediate ridges also may be used (e.g., 2-6 legs and/or intermediate ridges) without departing from this aspect of the invention.

Yet another example of cleats in accordance with at least some aspects of this invention include: (A) a cleat base including a first surface, a second surface opposite the first surface, and an outer perimeter, wherein the cleat base is made from a first material, and wherein the cleat base includes: (i) a set of perimeter openings extending from the first surface to the second surface and located adjacent the outer perimeter and (ii) a first inner opening at least partially located inside the set of perimeter openings; and (B) a cleat component extending through and/or engaged with the cleat base at the first inner opening, wherein the cleat component is made from a second material that is different from the first material, and wherein the cleat component includes: (i) a first (exterior) surface that includes one or more traction enhancing structures and (ii) a second (interior) surface opposite the first surface. In this example cleat structure, a bottom or base surface of the cleat is located inside the outer perimeter of the cleat base, wherein at least 95% of an area of the bottom or base surface of the cleat comprises the second surface of the cleat base, the second surface of the cleat component, and the set of perimeter openings, and wherein at least 95% of a combined surface area of the second surfaces of the cleat base and the cleat component is planar, substantially planar, or smoothly curved.

In the example cleat structures described above, if desired, the cleat base may be permanently engaged with the article of footwear, e.g., in-molded or otherwise permanently fixed to the sole structure of the shoe (although it may be releasably attached to the article of footwear, if desired). Additionally or alternatively, if desired, the cleat component may be releasably engaged with the cleat base so that the cleat component may be replaced on the cleat base, if desired. In some specific example structures in accordance with this invention, however, the cleat base will be in-molded or otherwise permanently fixed to the sole structure of the shoe (e.g., by cements or adhesives, by mechanical connectors, etc.) and the cleat component will be in-molded or otherwise permanently fixed to the cleat base (e.g., by cements or adhesives, by mechanical connectors, etc.), such that the entire cleat is permanently fixed with the article of footwear (e.g., fixed in a non-replaceable manner).

In cleat structures in accordance with at least some examples of this invention, the cleat component may include a central opening, and a portion of the cleat base may extend to and/or be exposed to an outer (exterior) surface of the cleat through this central opening. If desired, the portion of the cleat base exposed at the outer surface of the cleat through the central opening may be surrounded by the cleat component. If desired, in the final cleat structure, the material from which the cleat base is formed (e.g., a nylon material) may be harder than the material from which the cleat component is formed (e.g., a thermoplastic polyurethane material). The cleat base may be at least somewhat flexible, and it may be constructed so as to be free from threaded connectors, turnbuckle type connectors, and/or other structures for releasably engaging the cleat with an article of footwear. If the cleat base is flexible, this may help allow the cleat to feel more comfortable underfoot (e.g., to better conform with the foot shape). This flexibility likewise may enable the cleat base to flex as force is placed on the overall sole component, which may help the cleat to bend with the rubber or other material of the sole component rather than remaining stiff and unbent and pulling away from the material of the sole component.

The outer perimeter of the cleat base may surround a single cleat in at least some examples of this invention. If desired, at least 90% of an area of a bottom or base surface of the cleat located inside the outer perimeter of the cleat base may constitute a bottom or base surface of the cleat component and a bottom or base surface of the cleat base, and at least 95% of a combined surface area of the bottom or base surfaces of the cleat component and the cleat base may be planar, substantially planar, or smoothly curved. In some structures, at least 98% of this combined surface area may be planar, substantially planar, or smoothly curved.

In cleat structures in accordance with at least some examples of this invention, an exterior surface of the cleat base (i.e., the surface exposed to and in contact with the ground in use) may include one or more traction enhancing structures, such as fin cleats, nubs, pyramids, truncated pyramids, cylinders, and the like. These additional fraction enhancing structures may be located between adjacent legs of the cleat component.

Cleat components in accordance with at least some examples of this invention may include ridges that extend between adjacent legs of the cleat components. The overall cleat then may be formed so that portions of the cleat base surround the ridges and/or extend through openings provided in the ridges to thereby engage the cleat bases with the cleat components. In such structures, the cleat may be formed by first forming the cleat components (e.g., by an injection molding process) and then forming the cleat base around the cleat component, e.g., in an in-molding process.

Additionally, if desired, cleat structures in accordance with at least some examples of this invention may include the various features described above in any desired combinations or sub combinations.

Still additional aspects of this invention relate to sole structures for articles of footwear (e.g., including midsole and/or outsole components) that have cleat structures of the types described above, as well as to articles of footwear (e.g., golf shoes) incorporating cleat structures and/or sole structures of the types described above.

B. Sole Structures According to Aspects of this Invention

Additional aspects of this invention relate to sole elements for articles of footwear. Such sole elements, which may constitute outsoles, midsoles, or midsole/outsole combinations, may include: (A) a cleat including an interior surface, an exterior surface opposite the interior surface, and an outer flange or rim, wherein the outer flange or rim includes a first surface, a second surface opposite the first surface, and an outer perimeter edge extending between the first and second surfaces, and wherein a plurality of perimeter openings extending through the outer flange or rim are located adjacent (and inside) the outer perimeter edge; and (B) a sole component engaged with the cleat, wherein the sole component includes a continuous layer of material that at least partially covers the outer perimeter edge, extends over at least some of the first and second surfaces of the outer flange or rim, and extends through at least some of the plurality of perimeter openings. If desired, the sole component may completely cover the interior surface of the cleat, and the material of the sole component may completely fill the plurality of perimeter openings. The cleat may include the structures described above and/or any combination or subcombination of the cleat features and/or structures described above. Also, while it may be removable from the sole component, in some more specific structures in accordance with examples of this invention, the cleat (or at least the cleat base) will be permanently fixed to the sole component (e.g., by an in-molding process, by cements or adhesives, by mechanical connectors, etc.).

If desired, an exterior surface of the sole component (i.e., the surface exposed to and in contact with the ground in use) may include one or more traction enhancing structures, such as fin cleats, nubs, pyramids, truncated pyramids, cylinders, removable cleats, and the like. The base area of the sole component, exclusive of a thickness of any traction elements formed therein, may have a maximum thickness of 7 mm or less, and in some examples, 6 mm or less, or even 5 mm or less. If desired, some sole elements in accordance with examples of this invention will have an overall maximum thickness through the cleat and the sole component (e.g., cleat plus outsole plus midsole thickness or height) of 15 mm or less, and in some examples, 13 mm or less, 10 mm or less, or even 7 mm or less.

Any desired number of cleats, e.g., of the types described above, may be engaged with a single sole component without departing from this invention. The cleats provided on a given sole component may have the same or different constructions and/or may be engaged with the sole component in the same or different manners.

Still additional aspects of this invention relate to sole structures for articles of footwear including one or more sole elements of the types described above (e.g., including midsole and/or outsole components), as well as to articles of footwear (e.g., golf shoes) incorporating cleat structures and/or sole elements of the types described above. If desired, the overall sole structure may include an outsole component (e.g., formed of a rubber or TPU material) with the cleat incorporated into it (e.g., by in-molding), and this outsole component may be engaged with a midsole component (e.g., including a polymeric foam material, one or more fluid-filled bladders, and/or one or more mechanical impact force attenuating components). The combined midsole/outsole structure then may be engaged with one or more upper and/or other footwear components (e.g., by sewing or stitching, by adhesives or cements, and/or by mechanical connectors, etc.).

C. Mold Structures According to Aspects of this Invention

Additional aspects of this invention relate to mold structures, e.g., for making molded products including in-molded components (e.g., for making a sole element for an article of footwear including an in-molded cleat). Some mold structures in accordance with aspects of this invention will include: (a) a first mold component (e.g., a first mold plate) including a first portion of a mold cavity and (b) a second mold component (e.g., a second mold plate) including a second portion of the mold cavity for at least partially covering the first portion of the mold cavity. The first portion of the mold cavity may include: (i) a first area for forming and/or shaping a first portion of an article to be molded (e.g., a footwear sole structure, such as an outsole component), wherein the first area includes a first molding surface exposed in the mold cavity made from a first material having a first thermal conductivity, and (ii) one or more additional areas (e.g., also called "second" and "third areas herein) including a component receptacle for receiving a component to be in-molded into the article (e.g., for receiving a previously formed cleat element), wherein the component receptacle includes a second surface exposed in the mold cavity for engaging the component to be in-molded, and wherein the second surface is made from a second material having a second thermal conductivity that is less than the first thermal conductivity. If desired, a separate "second area" and/or component receptacle may be provided for each individual component (e.g., each individual cleat element) to be in-molded into the article. The individual "second areas" and/or component receptacles (when multiple areas and/or receptacles are present) may be completely separated from one another (e.g., such that the first molding surface forms a continuous path between the individual component receptacles and/or such that the first area of the mold cavity completely surrounds the individual component receptacle areas). The second mold component may completely cover the first portion of the mold cavity and/or completely cover one or more of the component receptacles.

As noted above, the first molding surface exposed in the mold cavity (for forming the first portion of an article to be molded (e.g., a footwear sole structure, such as an outsole component)) is made from a first material having a first thermal conductivity and the second surface exposed in the mold cavity (for engaging the component to be in-molded) is made from a second material having a second thermal conductivity that is less than the first thermal conductivity. As some more specific examples, the first material may include a metal or metal alloy material (e.g., aluminum, steel, etc.) and the second material may include at least one material selected from the group consisting of: a ceramic material, a polymeric material, and a polymeric material including a ceramic, metal, or metal alloy powder dispersed therein. By having a lower thermal conductivity, the material of the second surface (e.g., the in-molded component receptacle surface) will heat up less quickly than the material of the first molding surface. This enables in-molding of a component that may not be satisfactorily in-molded at the temperatures, pressures, and/or timing conditions necessary for molding the article to be molded (i.e., components that might normally melt and/or otherwise deform under the necessary molding conditions).

As a more specific example, a previously formed cleat component may be engaged within a mold cavity at a cleat receptacle made from the second material described above. Because the surface of the cleat receptacle has a lower thermal conductivity than the material of the surrounding area (against which the outsole component is shaped and/or formed), the cleat receptacle does not heat up as quickly as the surrounding molding surface. Because the cleat receptacle heats up more slowly than the remainder of the molding surface, the cleat component may be placed in the mold cavity and engaged with an outsole component by an in-molding process under timing, temperature, and/or pressure conditions that could cause the cleat component to melt or deform if it was engaged directly with the material against which the outsole component is formed. In effect, in this example, the material of the cleat receptacle maintains the area of the mold in contact with the cleat component at a lower temperature during the outsole rubber molding cycle to prevent the cleat component from melting or otherwise deforming during the outsole rubber molding process.

Molds of the types described above may be used to form outsole components including in-molded cleats of any desired construction, including outsole components and/or in-molded cleats of the various types described above (and described in more detail below).

D. Molding Methods According to Aspects of this Invention

Still additional aspects of this invention relate to methods of forming molded articles (e.g., footwear sole structures), e.g., using the mold structures described above. Such methods may include placing a component to be in-molded (e.g., a cleat component) in a mold cavity, wherein the component to be in-molded includes an in-molding engagement area (e.g., a perimeter area, such as a flange or rim), and wherein the mold cavity includes: (i) a first area that includes a first molding surface exposed in the mold cavity made from a first material having a first thermal conductivity, and (ii) one or more additional areas including one or more in-molded component receptacles (e.g., a cleat receptacle), wherein the in-molded component receptacle includes a second surface exposed in the mold cavity for engaging the component to be in-molded, wherein the second surface is made from a second material having a second thermal conductivity that is less than the first thermal conductivity, and wherein the component to be in-molded is engaged with the in-molded component receptacle. The method further may include introducing a moldable material into the mold cavity, wherein the moldable material flows around and/or through the in-molding engagement area of the component to be in-molded to engage the component to be in-molded with the moldable material. The mold may be held at temperature and/or pressure conditions for a sufficient time to enable the moldable material to flow to the desired areas to form the final article to be molded. Additional features of methods according to this aspect of the invention may include curing the moldable material after the step of introducing the moldable material into the mold cavity (inside or outside of the mold).

The moldable material may be introduced into the mold cavity in one or more steps. In some more specific examples, a first portion of the moldable material will be introduced into the mold cavity before the component to be in-molded is engaged with the component receptacle and then a second portion of the moldable material will be introduced into the mold cavity after the component to be in-molded is engaged with the component receptacle. In such methods, it may be necessary or desirable to clear the moldable material from the component receptacle area(s) before engaging the component to be in-molded with the receptacle area(s). Alternatively, if desired, the mold cavity may include an intermediate plate or other structure that prevents the moldable material from flowing over the component receptacle area(s) when the component(s) to be in-molded is (are) absent from the mold cavity.

When used to form outsole components with in-molded cleat elements of the types described above, molding methods according to aspects of this invention may further include engaging the outsole component (e.g., including a combined base footwear sole component and the in-molded cleat) with a midsole component, e.g., by cements or adhesives, by mechanical connectors, etc. The midsole component may have any desired structure without departing from this invention, including, for example, midsole components including a polymeric foam material, midsole components includes one or more fluid-filled bladders (optionally with the fluid-filled bladder(s) at least partially surrounded by a foam material), midsole components including one or more mechanical impact force attenuating structures, etc.

Sole structures of the types described above (including those made by the methods described above) may be incorporated into an article of footwear, e.g., to one or more upper components), in any desired manner, including in manners that are conventionally known and used in the footwear art.

Given the general description of features, aspects, structures, processes, and arrangements according to certain embodiments of the invention provided above, a more detailed description of specific example structures and methods in accordance with this invention follows.

II. Detailed Description of Example Structures and Methods According to this Invention Referring to the figures and following discussion, various articles of footwear, footwear components, and features thereof in accordance with the present invention are described. The footwear depicted and discussed are golf shoes, but the concepts disclosed with respect to various aspects of this invention may be applied to a wide range of cleated or other athletic footwear styles, including, but not limited to: football shoes, hiking shoes, soccer shoes, baseball shoes, track shoes, and the like. Still additional concepts and aspects of this invention, such as the mold construction and molding method concepts and aspects of the invention, may be applied to production of other products, such as other products in which one or more permanently attached, in-molded components may be desired. Accordingly, the present invention is not limited to the precise embodiments disclosed herein, but it applies more generally to other types of footwear and/or other product lines.

Figure 1B:
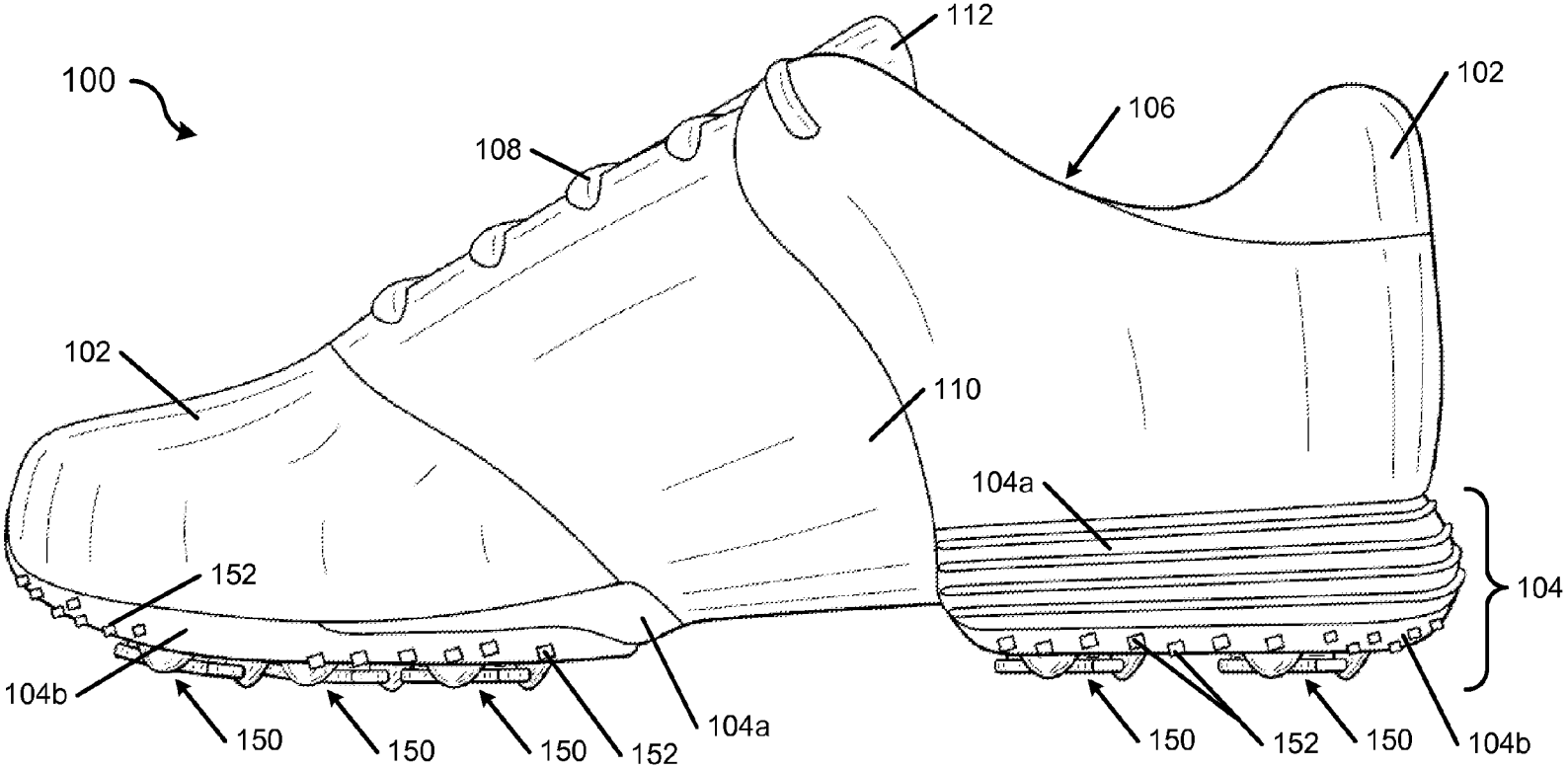
Figures 1C, 1D:
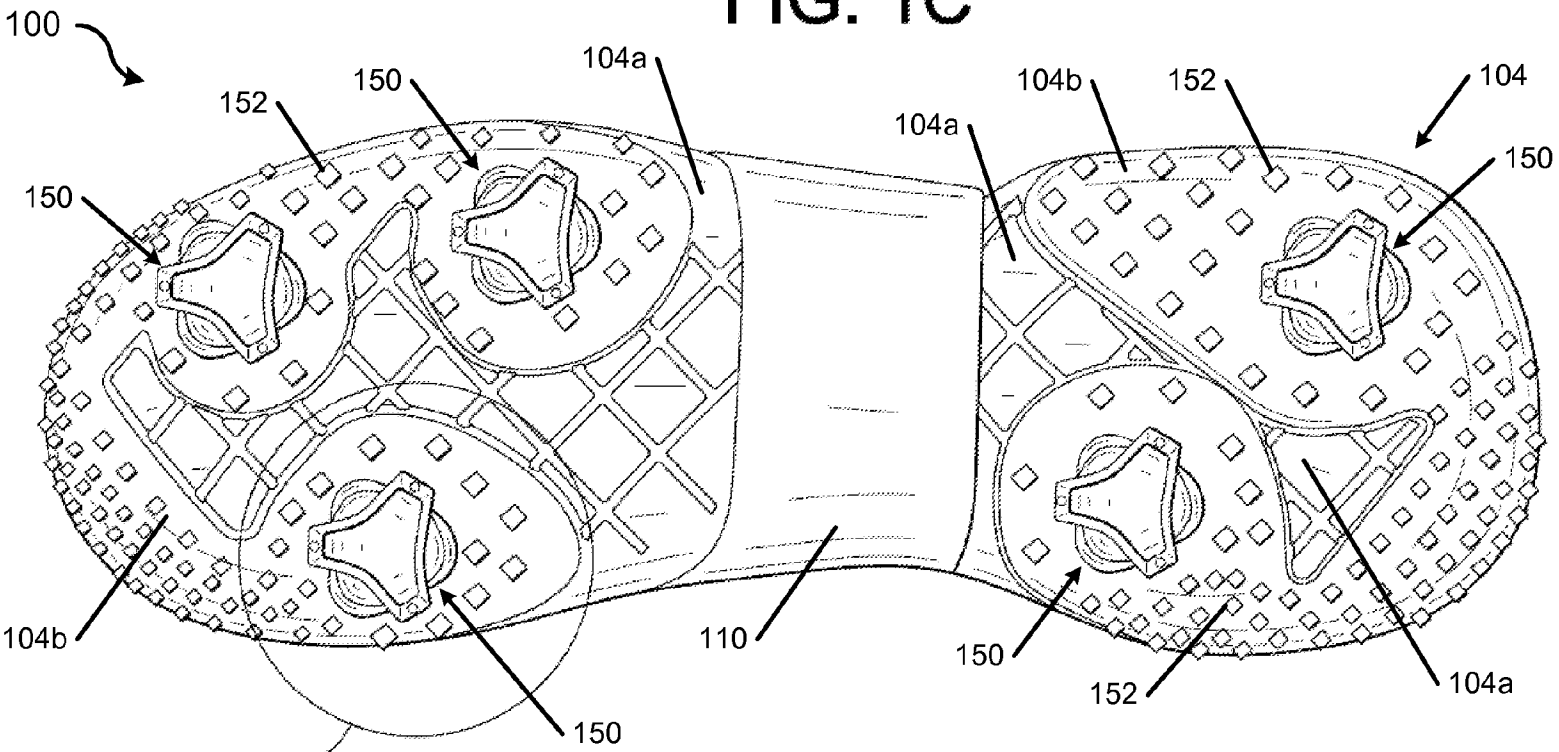
Figure 1D:
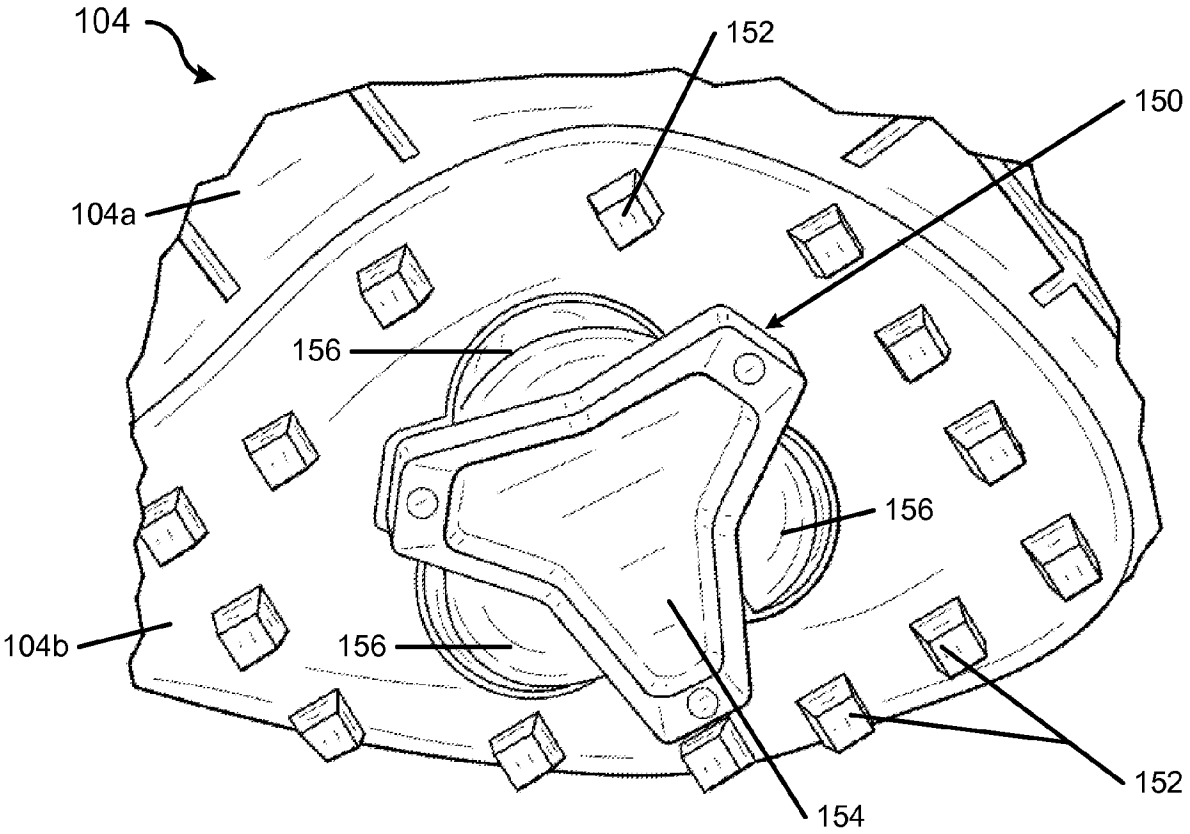

FIGS. 1A and 1B show medial and lateral side views, respectively, of a golf shoe 100 in accordance with some aspects of this invention. FIG. 1C provides a bottom view of this example golf shoe 100, and FIG. 1D provides an enlarged close-up view of one cleat element 150 provided on this example golf shoe 100. The shoe 100 includes an upper 102 and a sole structure 104 engaged with the upper 102. The upper 102 may be made from any desired material or combination of materials without departing from this invention, including from material(s) and/or construction(s) as are generally known and used in the footwear art. Some more specific examples of upper 102 materials include fabric or textiles, leathers (synthetic or natural), polymeric materials, spacer meshes, and the like. The upper 102, at least in part, defines a foot-receiving opening 106 through which the wearer inserts a foot to don the shoe 100. Laces 108 or other securing or foot engagement structures may be provided to securely hold the shoe 100 to a wearer's foot. In this illustrated example, the lace 108 engages a strap element 110 that wraps around the shoe 100 (including around and across the bottom of the sole structure 104) to help conform the shoe to the wearer's foot as the lace 108 is tightened. Also, if desired, the strap element 110 can be removable (e.g., by unlacing the lace 108) and replaced by another strap element 110, e.g., to change colors, styles, and/or shapes of the strap element 110, to otherwise change the appearance and/or feel of the strap element 110, etc. A tongue member 112, bootie, or other similar type structure may be provided at the shoe instep area, e.g., to increase comfort and/or to moderate the pressure and feel applied to the wearer's foot by the lace 108.

The sole structure 104 may be engaged with the upper 102 in any desired manner, including in manners that are conventionally known and used in the footwear art (e.g., by sewing or stitching, by adhesives or cements, by mechanical connectors, etc.). In this illustrated example, the sole structure 104 includes a midsole component 104*a* and an outsole component 104*b* engaged with the midsole component 104*a*. This engagement may be accomplished in any desired manner, including manners that are conventionally known or used in the footwear art (e.g., by cements or adhesives, by mechanical connectors, by sewing or stitching, etc.). In this illustrated example, the outsole component 104*b* is formed by a molding process (which will be described in more detail below) separate from the midsole component 104*a*, and the outsole component 104*b* is formed in a shape to fit into shallow recesses formed in the surface of the midsole component 104*a*. The two parts 104*a*, 104*b* are fixed to one another by cement in this example.

The midsole component 104*a* may be made from any desired materials and/or in any desired manner without departing from this invention, including from conventional materials and in conventional manners as are known and used in the art. As some more specific examples, the midsole component 104*a* may be formed from and/or include one or more of: a polymeric foam material (e.g., a polyurethane foam, an ethylvinylacetate foam, etc.); one or more fluid-filled bladders (e.g., optionally at least partially incorporated into a foam material and/or a plastic cage type structure); one or more polymeric foam columns (e.g., like the columns provided in NIKE SHOX™ type footwear); one or more mechanical impact force attenuating components; etc. In some examples, the midsole component 104*a* may be at least partially made from a foam material having a density of less than 0.25 g/cm$^3$ (and in some examples, a density of less than 0.2 g/cm$^3$, within the range of 0.075 to 0.2 g/cm$^3$, and even within the range of 0.1 to 0.18 g/cm$^3$); a foam material as described, for example, in U.S. Pat. No. 7,941,938 (which patent is entirely incorporated herein by reference); and/or a foam material from the "LUNAR" family of footwear products available from NIKE, Inc. of Beaverton, Oreg. The midsole component 104*a* also may be formed from any desired number of independent pieces or parts without departing from this invention.

The outsole component 104*b* of this example shoe structure 100 also may be made from any desired materials without departing from this invention, including from conventional materials as are known and used in the art. In accordance with at least some aspects of this invention, the outsole component 104*b* may be made from a synthetic rubber material (e.g., a conventional outsole rubber material). The sole structure 104 of this example footwear structure 100 includes two separate outsole components 104*b* engaged with a single polymeric foam midsole component 104*a* by cement or adhesive. Outsole components 104*b* and production systems and methods therefore in accordance with some aspects of this invention will be described in more detail below.

As shown in FIGS. 1A through 1D, each separate outsole component 104*b* of this example footwear structure 100 includes a plurality of cleat elements 150 (or other fraction enhancing components) engaged with it. While an individual outsole component 104*b* may have any desired number of separate cleat elements 150 engaged with it (including zero), in this illustrated example, the forefoot outsole component 104*b* has three cleat elements engaged with it (one on the medial side (inside) edge of the shoe 100 and two on the lateral side (outside) edge, with the center of the medial cleat 150 located between the centers of the two lateral cleats 150 in the front-to-back direction). Similarly, the heel outsole component 104*b* has two cleat elements 150 engaged with it (one on the rear lateral side and one on the medial side and forward of the other). Other cleat numbers, arrangements, and orientations are possible without departing from this invention.

FIGS. 1A through 1D further illustrate that the outsole components 104*b* of this example structure 100 include a plurality of secondary traction elements 152 integrally formed on the exterior (bottom) surface of the outsole component 104*b*. While a plurality of raised nubs (e.g., cylinders or truncated pyramids) are shown in the figures, other traction element structures are possible without departing from this invention, such as raised fin type cleat structures, raised ribs, recessed grooves, etc. While provided primarily on the bottommost contact surface of the outsole component 104*b*, if desired, at least some of these secondary traction elements 152 may be provided along a side area of the sole structure 104 (e.g., as shown in FIGS. 1A and 1B). These side oriented secondary traction elements 152 can be particularly useful, for example, as the user's weight shifts during the course of a golf swing, during a cutting or rapid direction change maneuver, etc.

Figure 2A:
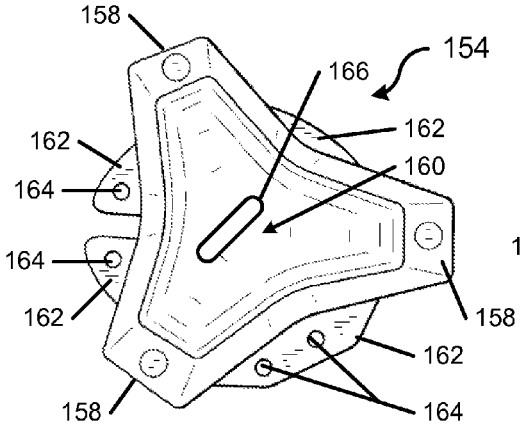
FIGS. 2A through 2E illustrate various views of cleat structures according to examples of this invention.
Figure 2B:
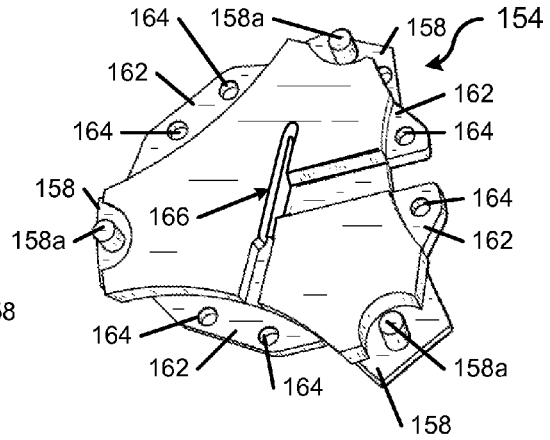
Figure 2E:
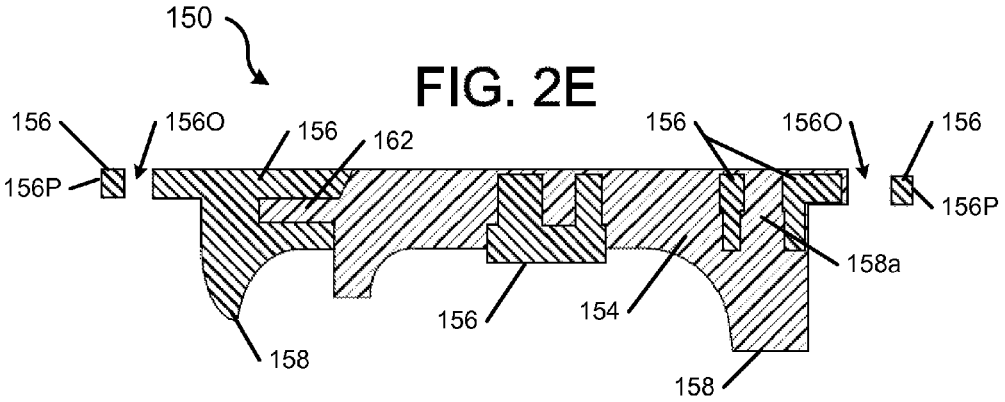
Figure 2D:
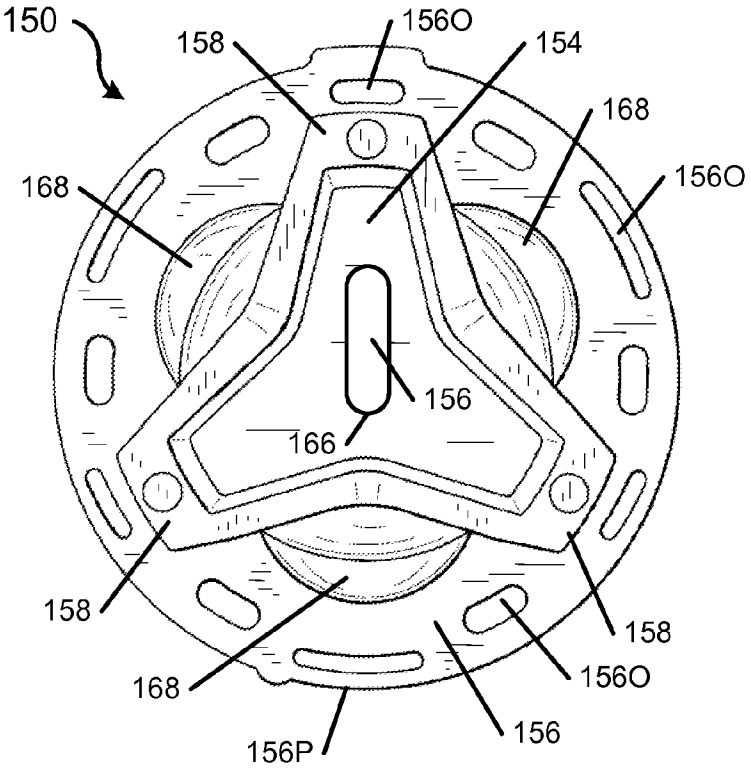
Figure 2C:
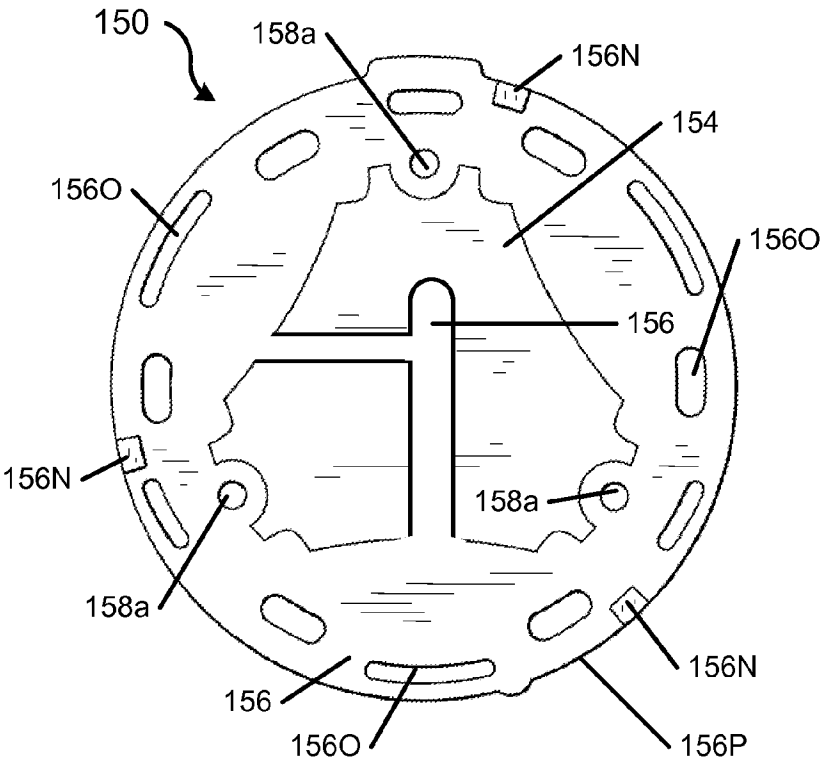

More specific features and components of an example cleat structure 150 in accordance with at least some examples of this invention will be discussed below in conjunction with FIGS. 2A through 2E. This example cleat structure 150 includes a cleat component 154 (e.g., including traction enhancing element structures) and a cleat base 156. The cleat component 154 may be engaged with the cleat base 156 in any desired manner, including through the use of cements or adhesives, via a friction fit, via detents or spring loaded type connections, etc. FIGS. 2A and 2B provide top and bottom views, respectively, of the cleat component 154, and FIGS. 2C-2E provide bottom, top, and cross sectional views of the overall cleat structure 150.

The cleat component 154 and the cleat base 156 may be made from any desired materials without departing from this invention. In some specific example cleat constructions according to this invention, the cleat component 154 will be formed from a thermoplastic polyurethane material (TPU) and the cleat base 156 will be formed from a nylon 66 material. Other materials and/or combinations of materials also may be used without departing from this invention, including material combinations in which, in the finished cleat product, the cleat component 154 is made from a softer material than the cleat base 156, although the cleat base 156 may remain at least somewhat flexible (particularly at its perimeter flange or rim area). As some more specific examples, the finished cleat component 154 may be made from a TPU material having a Shore A hardness ranging from 80 to 120 (and in some examples, in a range from about 90-100 Shore A, or even about 92-96 Shore A). In terms of Shore D hardness, the finished cleat component 154 of some example structures may be made from a TPU material having a Shore D hardness ranging from 36 to 52 Shore D (and in some examples, in a range from about 40-48 Shore D or even from about 42-46 Shore D). The finished cleat base 156 may be made from a nylon material having a Shore D hardness of about 70 to 88 Shore D, and in some examples, within the range of 75 to 85 Shore D or even 76 to 82 Shore D.

In some examples of this aspect of the invention, the cleat structure 150 may be made from the two parts noted above by an in-molding process. More specifically, first the cleat component 154, e.g., as shown in FIGS. 2A and 2B, may be produced as a single part, for example, by an injection molding process. As shown in FIGS. 2A and 2B, this example cleat component 154 (which may be made from thermoplastic polyurethane material) may include a plurality of legs 158 that form some of the traction-enhancing elements of the cleat 150. The cleat component 154 constitutes a single piece construction in which the legs 158 extend outward (toward the sides) from a common central area 160. An anchor post 158*a* extends from the bottom side or underside of at least some of the legs 158 (toward an overall bottom or base surface of the cleat component 154). While it is not required, preferably each leg 158 will include at least one anchor post 158*a*, and multiple anchor posts 158*a* may be provided on at least some of the legs 158, if desired. Any desired number of legs 158 (and/or any other desired types of traction enhancing structures) and/or anchor posts 158*a* may be provided on the cleat component 154.

As further shown in FIGS. 2A and 2B, this example cleat component 154 further includes ridges 162 that extend between adjacent legs 158. While it is not required, preferably each adjacent pair of legs 158 will include at least one ridge 162, and the ridge 162 may be continuous or discontinuous as it extends between the legs 158. If desired, these ridges 162 may be formed to include one or more recesses, grooves, or openings 164.

The anchor posts 158*a*, ridges 162, and/or openings 164 provide additional support and/or surface area for engaging the cleat base 156, as will be described in more detail. As noted above, production of the cleat 150 may include an initial step of forming the cleat component 154, e.g., by an injection molding process. One or more of the cleat components 154 thus formed then may be placed in another mold (or the mold in which they are formed may be modified), and the material of the cleat base 156 (e.g., nylon 66) may be molded around the material of the cleat component 154. In this additional molding step, the flowable material of the cleat base 156 may be injected into the mold so that material of the cleat base 156: (a) flows around and surrounds at least the sides of the anchor post(s) 158*a*, (b) extends around the upper surface, peripheral edge, and lower surface of the ridges 162, and (c) extends into or through the recesses, grooves, or openings 164. Once the material of the cleat base 156 is cured or hardened, it forms a continuous, one piece structure around the anchor post(s) 158*a* and ridges 162 and through the openings 164 of the cleat component 154 (thus "in-molding" the cleat component 154 into a central opening left in the cleat base 156). This continuous in-molded construction helps prevent undesired separation of the cleat component 154 from the cleat base 156 irrespective of the relative forces applied between these components (e.g., tensile, pulling force, torsional force, etc.). In this illustrated structure, as shown in FIGS. 2C-2E, the outer perimeter 156P of the cleat base 156 forms an outermost perimeter of the overall cleat structure 150.

Additional features of this example cleat structure 150 now will be described. As shown in FIGS. 2C-2E, the cleat base 156 of this example structure 150 is formed (e.g., during the in-molding procedure mentioned above) to include a set of perimeter openings 156O or grooves located adjacent and inside the outer perimeter 156P of the cleat base 156. These openings 156O, which may vary widely in numbering, positioning, shape, etc., provide support and surface area for engaging the cleat 150 with a footwear sole structure 104, as will be described in more detail below. In addition, the bottom or interior base surface of the cleat base 156 may be formed to include one or more raised elements 156N (e.g., 0.5 to 4 mm high ridges, nubs, etc., see FIG. 2C), which also can provide additional anchoring support for the cleat 150 to sole structure 104 engagement described in more detail below. The numbers, locations, shapes, orientations, and/or relative positioning of the openings or grooves 156O and/or raised elements 156N may be varied widely without departing from this invention.

In the cleat structure 150 illustrated in FIGS. 2C-2E, an entire bottom or base surface of the cleat 150 is located inside the outer perimeter 156P of the cleat base 156, and this perimeter 156P surrounds a single cleat structure 150. In at least some structures in accordance with examples of this invention, at least 90% (and in some examples, at least 95%) of an area of the bottom or base surface of the cleat comprises: (a) a bottom or base surface of the cleat component 154, a bottom or base surface of the cleat base 156, and the set of perimeter openings 156O (see FIG. 2C). In such structures, at least 90% of a combined surface area of the bottom or base surfaces of the cleat component 154 and the cleat base 156 (excluding the missing surface at openings 156O) is planar, substantially planar, or smoothly curved, and in some examples, at least 95% or even at least 98% of this combined surface area is planar, substantially planar, or smoothly curved. As a more specific example, as shown in FIG. 2C, the area corresponding to the raised nubs 156N from the bottom or base surface of cleat base 156 may constitute less than 5% (and in some examples, less than 2%) of the combined bottom or base surface area of cleat base 156 and cleat component 154, and the bottom or base surfaces of the cleat base 156 and the cleat component 154 are planar, substantially planar, or smoothly curved over their own surfaces and with respect to one another. Notably, as evident from FIGS. 2C and 2E, the bottom or base surface of this cleat structure 150 does not include a threaded base member or a turnbuckle type releasable attachment structure.

FIGS. 2A through 2E illustrate additional features that may be included in cleat structures 150 in accordance with at least some examples of this invention. As shown in FIGS. 2A and 2B, the cleat component 154 may be formed to include a central opening 166 (e.g., through the common central area 160). During the in-molding process for forming the cleat 150, the flowable material of the cleat base 156 may be injected into the mold so that a portion of the cleat base 156 material extends to and is exposed to an outer surface of the cleat 150 through the central opening 166. Thus, in this central area 160, the portion of the cleat base 156 material exposed at the outer surface of the cleat structure 150 through the central opening 166 is surrounded by the material of the cleat component 154. This feature also can help anchor the cleat component 154 with the cleat base 156.

The portion of the cleat base 156 material exposed at the outer surface of the cleat structure 150 through the central opening 166 may have any desired color, shape, and/or orientation without departing from this invention. For example, if desired, the exposed cleat base 156 material at the central opening 166 may be a different color from the surrounding cleat component 154 material and may take on the shape of a logo, design, or word. Also, if desired, the central area 160 of the cleat component 154 may have plural openings 166 of this type.

As additional potential features, if desired, the exterior or exposed surface of the cleat base 156 may include one or more traction enhancing structures. In this illustrated example, the exterior surface of the cleat base 156 includes traction enhancing structures located between each adjacent pair of legs 158 of the cleat component 154 (although more traction enhancing structures may be provided, if desired). While any desired traction enhancing structure may be used without departing from this invention, in the illustrated example structure 156 shown in FIG. 2D, the exterior surface of the cleat base 156 includes fin cleat elements 168 located between each pair of adjacent legs 158 of the cleat component 154. These fin elements 168 are integrally formed in the material of the cleat base 156 during the molding process at the areas thereof that overlie the ridges 162 and openings 164 of the cleat component 154.

As mentioned above, cleat structures 150, e.g., of the types described above, may be incorporated into a sole structure 104 of an article of footwear 100, such as engaged with an outsole component 104*b* of the article of footwear 100. While this engagement may take on a variety of forms, in one example of this invention, one or more cleat structures 150 (e.g., of the types described above) are permanently engaged with an outsole component 104*b* by an in-molding process. With the more specific cleat construction 150 of the type described above, however (with a nylon cleat base 156 and a TPU cleat component 154 engaged with it), portions of the cleat 150 may be subject to deformation (e.g., melting, disfiguration, etc.) when processed under molding conditions (e.g., time, temperature, and/or pressure) needed to shape the material (e.g., synthetic rubber) of the outsole component 104*b*. Accordingly, additional aspects of this invention relate to mold structures and molding methods that allow in-mold attachment of cleats 150 with an outsole component 104*b*, as will be described in more detail below.

Figure 3B:
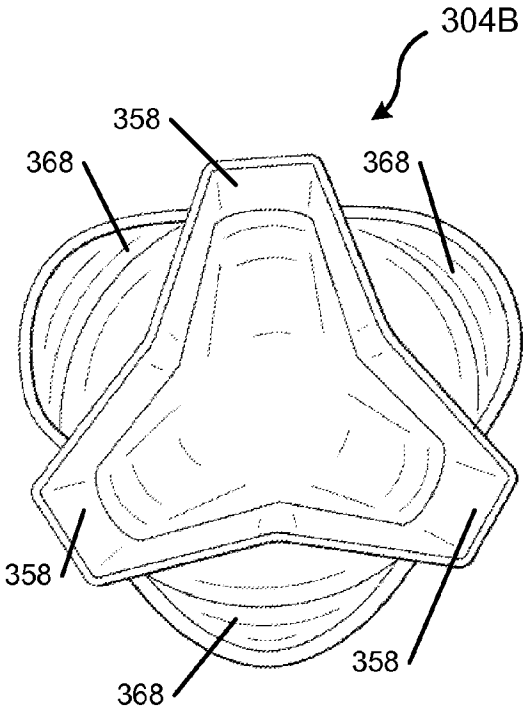
FIGS. 3A through 3H provide various views illustrating features of mold structures, methods of molding, and molded products according to examples of this invention.
Figure 3A:
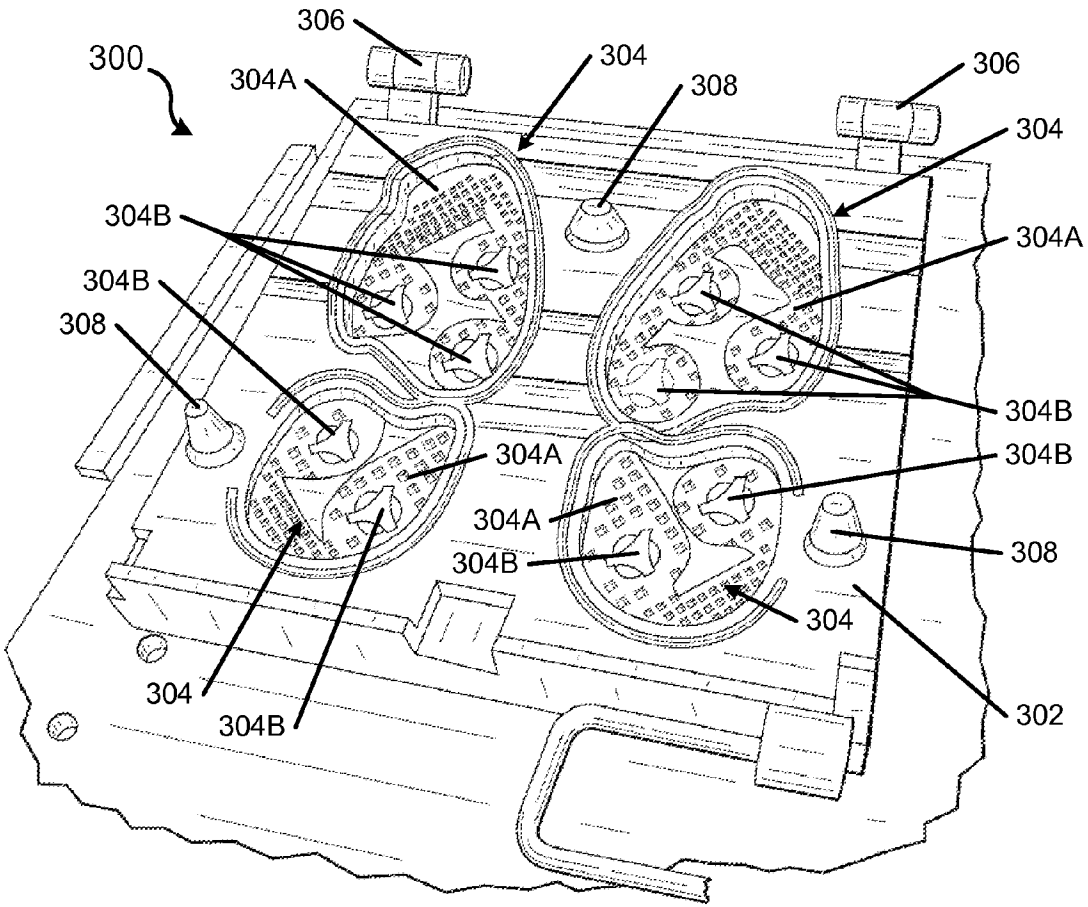

FIGS. 3A and 3B illustrate various features of a mold 300 according to at least some examples of this invention, e.g., for forming a sole element of an article of footwear, such as an outsole component (e.g., like component 104*b* with cleat element 150 in-molded therewith). The mold 300 includes a first mold component 302 (e.g., a mold plate) including a first portion of one or more mold cavities 304 in which the outsole component is formed. As shown in FIG. 3A, a single mold component 302 may include a plurality of different mold cavities 304, which may be interconnected or completely separated from one another. The first portion(s) of the mold cavity 304 in this example mold structure 300 include a first area for forming a base footwear sole component (e.g., outsole element 104*b*). As shown in FIG. 3A, the first area includes a first molding surface 304A exposed in the mold cavity 304 made from a first material having a first thermal conductivity. In the illustrated example, the first molding surface 304A is made from a metal or metal alloy material, such as aluminum or aluminum alloys, iron or iron alloys, steels, etc. In this illustrated example, the first molding surface 304A includes indentations for integrally forming the raised nub structures 152 described above.

This same mold cavity 304 includes one or more cleat receptacles 304B (ten total cleat receptacles 304B are shown in the four separate mold cavities 304 of the mold 300 illustrated in FIG. 3A). The cleat receptacle 304B constitutes a second surface exposed in the mold cavity 304 for engaging a previously formed cleat 150 (or other component to be in-molded into the base structure). The cleat receptacle 304B of this illustrated example includes a surface made from a second material having a second thermal conductivity that is less than the first thermal conductivity of the material of the molding surface 304A. In other words, the cleat receptacle surface 304B is made from a material that does not heat up as quickly as the material making up the molding surface 304A. As some more specific examples, the cleat receptacle 304B (at least its surface exposed in the mold cavity 304) may be made from one or more of: a ceramic material (e.g., silica, alumina, zirconia, carbides, borides, nitrides, silicides, etc.), a polymeric material (e.g., a low thermal conductive polymer), and a polymeric material including a ceramic, fiber, metal, or metal alloy powder dispersed therein. As some more specific examples, the cleat receptacle surface 304B may be made using an organic binder material that may contain, for example, one or more of: (a) a mixture of an epoxy (e.g., 10-15% by weight in component (a)), an amino resin compound (e.g., 10-15% by weight in component (a)), and a filling agent (e.g., a thickener in an amount of 70-75% by weight in component (a)) and (b) a hardening agent. If desired, components (a) and (b) above may be present in amounts of about 1:1 in the organic binder.

The cleat receptacles 304B of FIGS. 3A and 3B constitute "negatives" of at least some portions of the top surface of cleat component 154 and cleat base 156 shown in FIGS. 2A-2E so that the cleat structures 150 will securely fit in the cleat receptacles 304B while the outer perimeter flange or rim (e.g., a disk or washer-like rim or edge) of the cleat structure 150 extends beyond the edges of the cleat receptacle 304B. In this illustrated example, the cleat receptacles 304B include recessed surfaces 358 for engaging and holding the legs 158 of cleat component 154 and recessed surfaces 368 for engaging and holding the fin cleats 168 of cleat base 156. The recessed surfaces 358 and 368 prevent rapid heat up of cleat component 154 and cleat base 158 during the outsole molding process (because of their lower thermal conductivity) and help prevent movement of the cleat structure 150 during the outsole molding process (e.g., when flowable outsole material is injected into the mold 300).

When multiple cleat receptacles 304B are present in a single mold cavity 304, the materials of the cleat receptacles 304B may be completely separated from one another, e.g., the material of the first molding surface 304A may form a continuous path between the separated cleat receptacles 304B within a given mold cavity 304. In such structures, the material of the molding surface 304A may completely surround each individual cleat receptacle 304B. Alternatively, if desired, a single cleat receptacle area 304B may be sized and shaped so as to engage two or more cleat structures 150.

The mold 300 further may include a second mold component including a second portion of the mold cavity (e.g., a plate with a flat or shaped interior surface) for at least partially (and optionally completely) covering the first portion of the mold cavity 304. While the second mold component is not shown in the figures, FIG. 3A illustrates hinge components 306 at which the second mold component may engage the first mold component 302 in a rotatable manner. If necessary, one or more intermediate plates may be provided between the mold component 302 and the second mold component, at least at some times during a molding procedure. Alignment aids 308 help assure proper orientation and positioning of the mold components with respect to one another as the mold 300 is closed during a molding process. The second mold component may constitute a single plate, e.g., that completely covers all of the mold cavities 304 and completely covers all of the cleat receptacle(s) 304B. Optionally, if desired, the interior surface of the second mold component (or an intermediate plate) may include areas having a lower thermal conductivity (the same as or similar to the material of receptacles 304B), e.g., at areas covering or adjacent the cleat receptacles 304B.

Figure 3C:
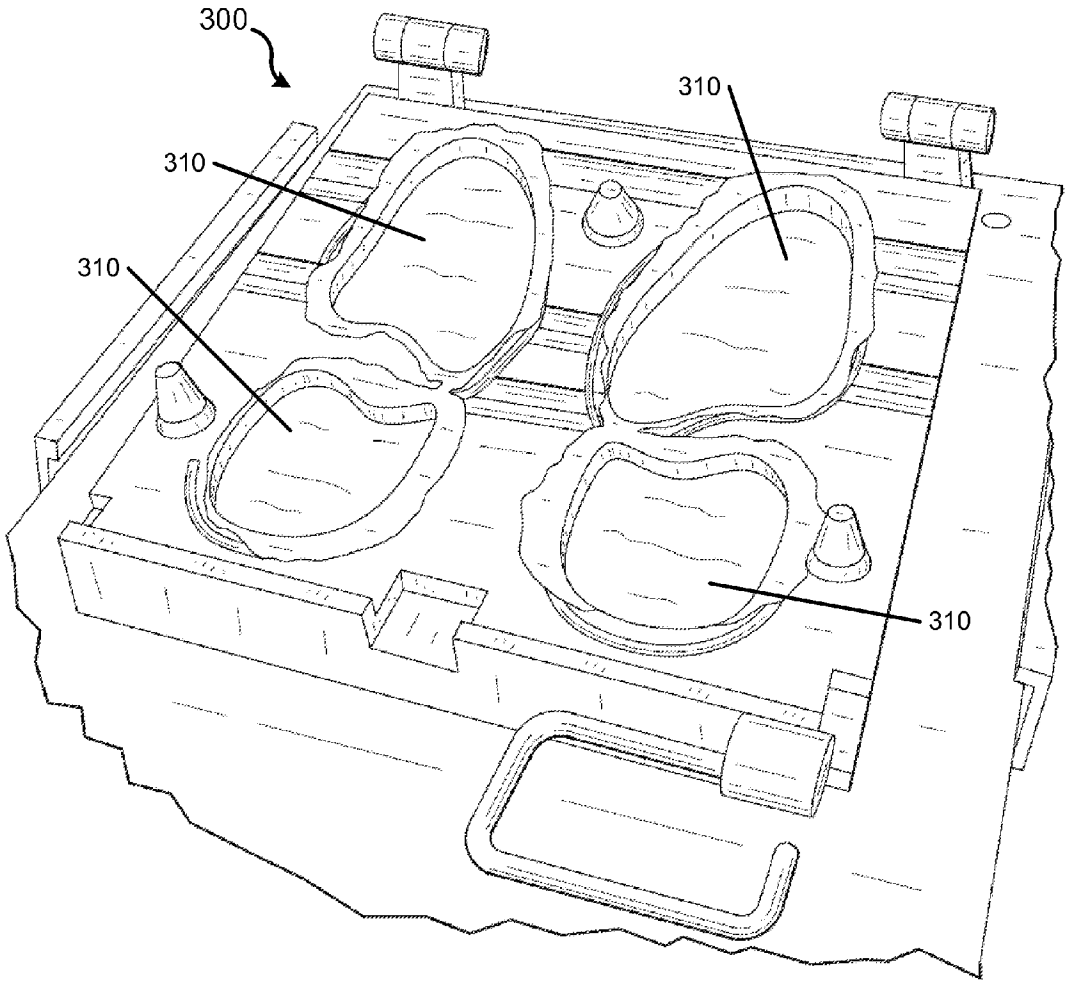

One example of a molding procedure for attaching a component to be in-molded (e.g., a cleat element 150) with another article (e.g., an outsole component) is described below in conjunction with FIGS. 3A-3G. First, starting with the mold structure 300 shown in FIG. 3A, the mold 300 is closed (i.e., the mold components are brought together by relative rotation on the hinges 306). One or more intermediate plates may be provided between (and optionally engaged with one or both of) the mold component 302 and the second mold component. A first shot of outsole material (e.g., synthetic rubber) then may be injected into the enclosed mold cavities 304 to create a layer of outsole material 310 within the mold cavities 304 as shown in FIG. 3C. In this example process, the layer of outsole material 310 completely covers the cleat receptacles 304B, although an interior surface of the intermediate plate and/or the second mold component (i.e., the surface located within the mold cavity 304 when the mold 300 is closed) may be shaped so as to prevent the outsole material 310 from covering the cleat receptacles 304B, if desired.

Figure 3D:
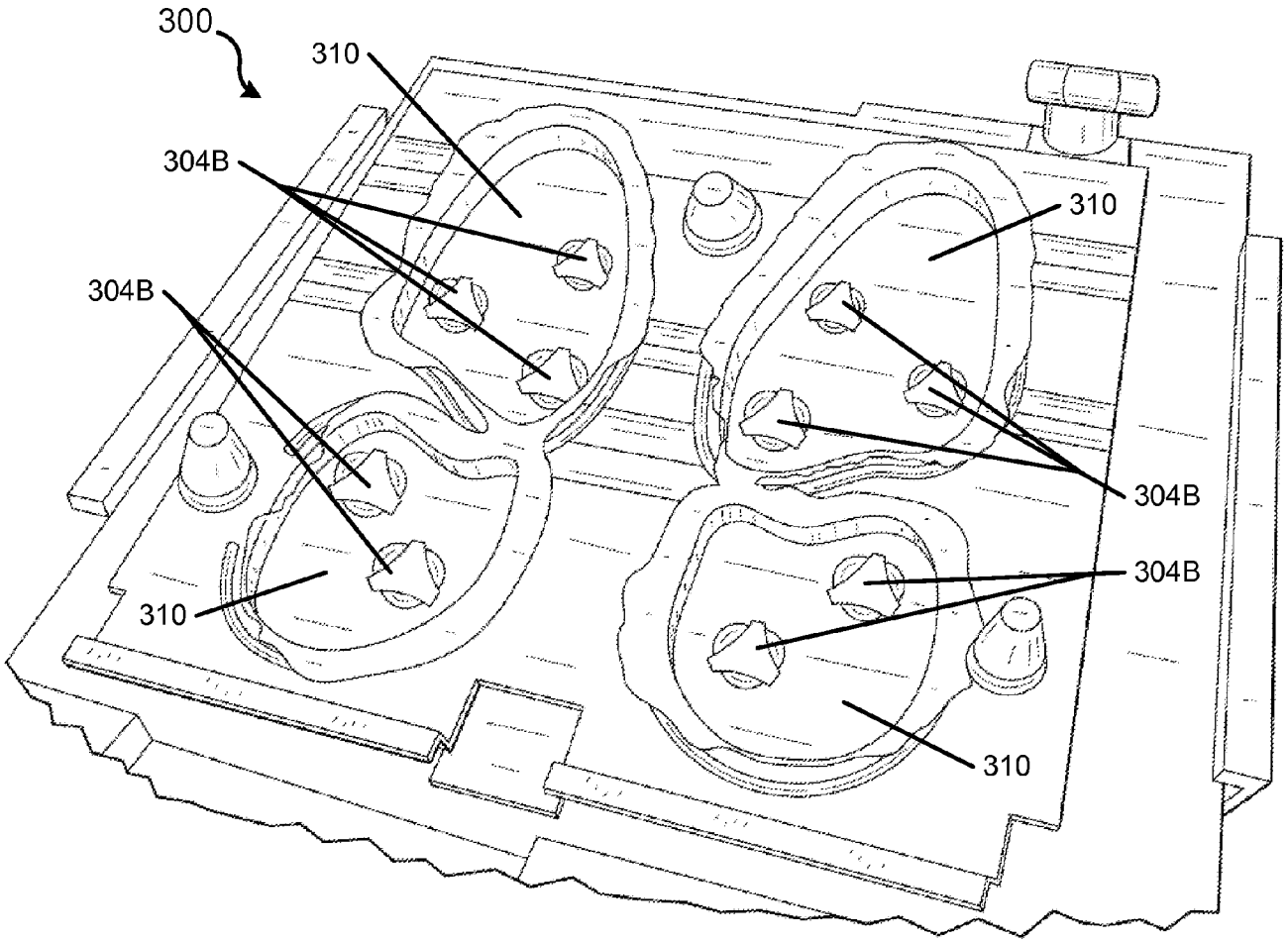
Figure 3E:
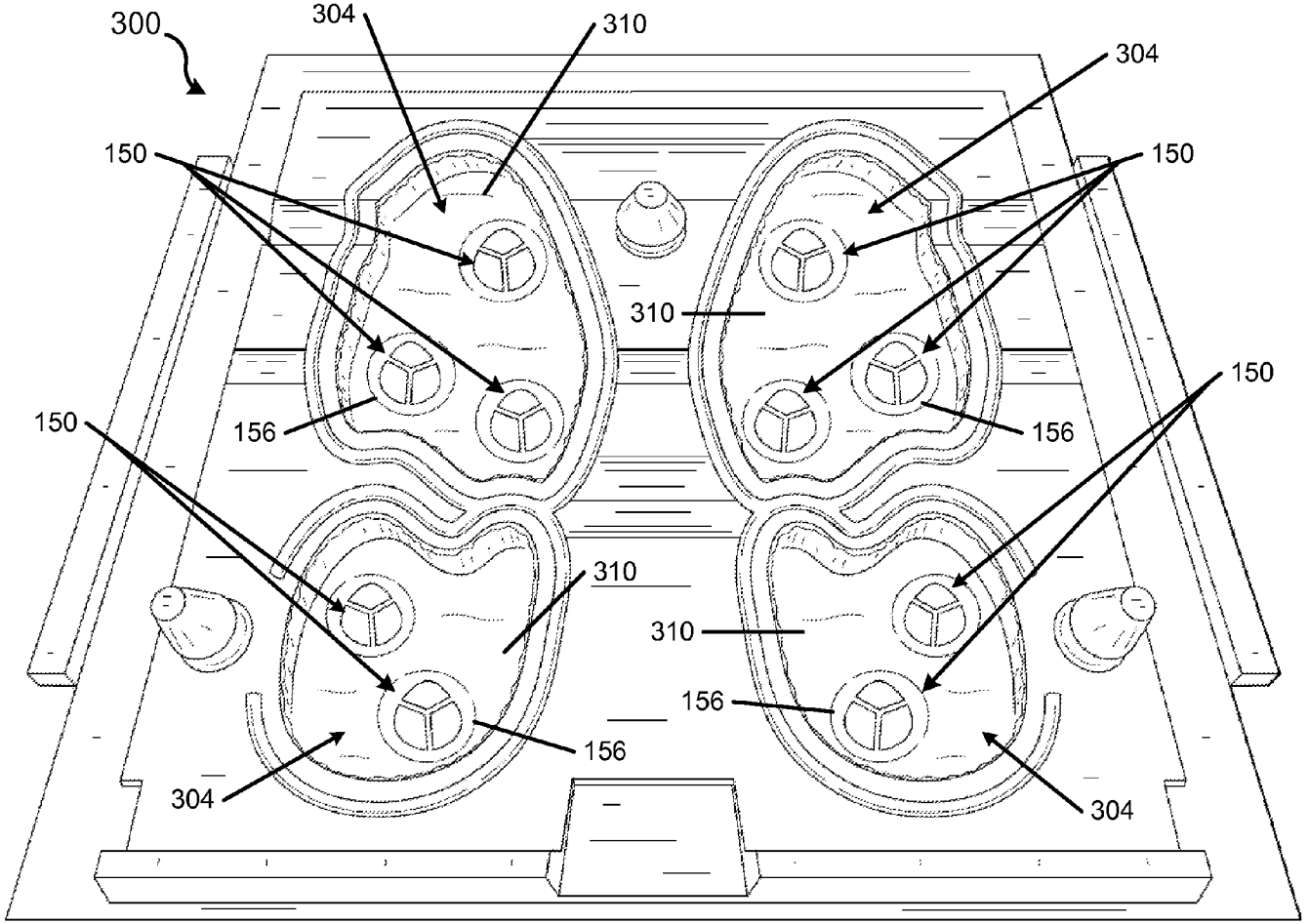

In the next step, as shown in FIG. 3D, the outsole material 310 is cleared off the areas above the cleat receptacles 304B to thereby expose the cleat receptacles 304B within the mold cavities 304. This may be accomplished by cutting the outsole material 310 around each receptacle 304B, e.g., using a knife or blade. Then, as shown in FIG. 3E, previously formed cleat elements 150 (e.g., as shown in FIGS. 2C-2E) are fit into the cleat receptacles 304B so that the bottom or interior base sides of the cleat elements 150 face the interior of the mold cavities 304. The outer perimeter or rim of the cleat base 156 (including the openings 156O not shown in FIG. 3E) may extend outward beyond the edges of the cleat receptacles 304B. Also, while the downward oriented surface of the outer perimeter or rim of the cleat base 156 may lie flush with (or even press into) the surface of the already present outsole material 310 in the mold cavities 304, in some examples of this aspect of the invention, the downward oriented surface of the outer perimeter or rim of the cleat base 156 may be somewhat elevated with respect to the surface of the already present outsole material 310 in the mold cavities 304 (i.e., the cleats 150 may be fully supported by the cleat receptacles 304B such that the cleat base 156 outer rim is suspended above the outsole material 310 in the bottom of the mold cavities 304).

Figure 3F:
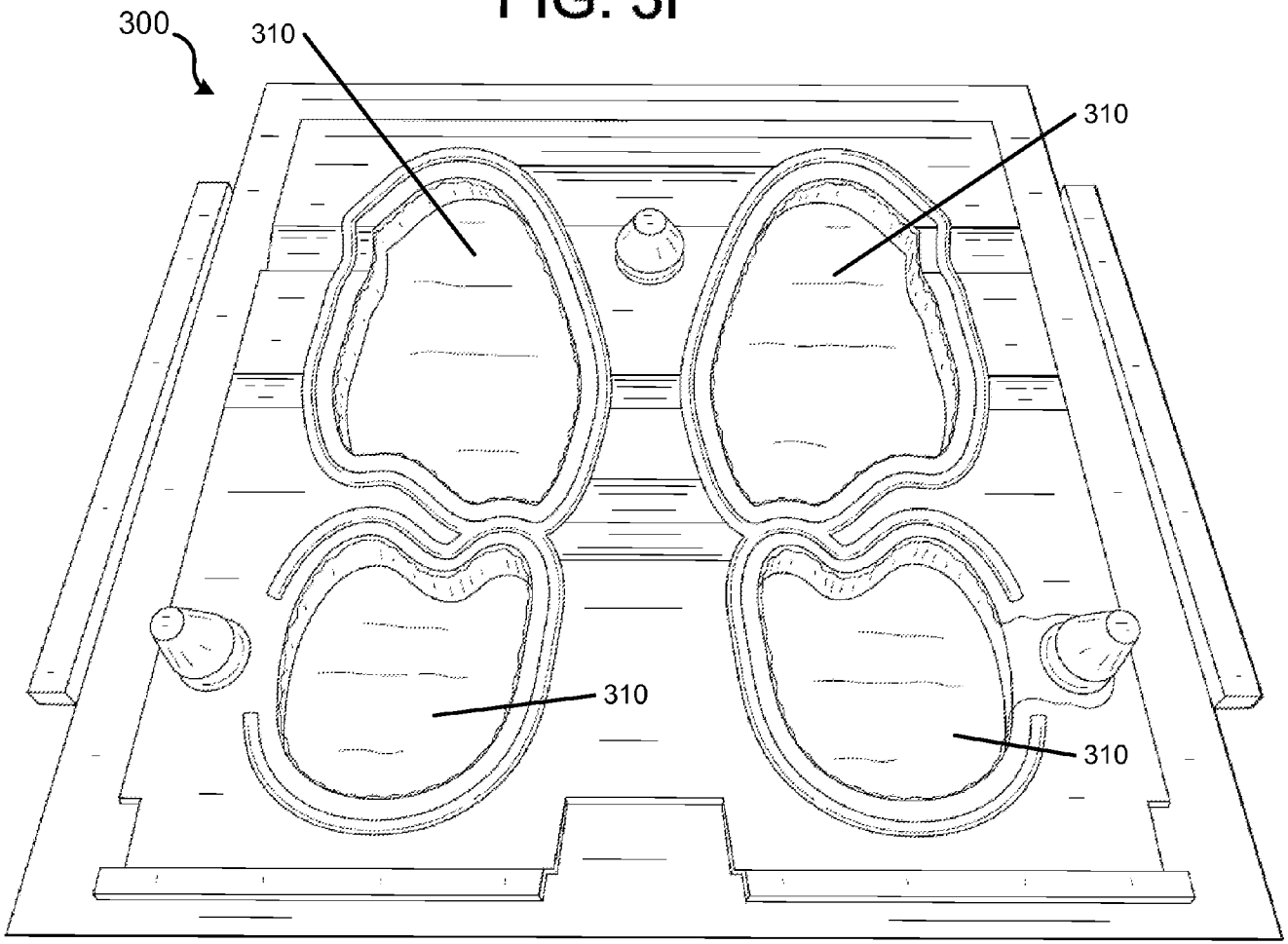

The mold 300 is then closed again and additional flowable outsole material 310 (the same or different from that previously introduced) is again introduced into the mold cavities 304. If desired, as shown in FIG. 3F, sufficient moldable outsole material 310 may be introduced to completely cover the interior surfaces of the cleat elements 150. This action further causes the flowable outsole material 310 to cover and/or surround the outer perimeter or rim of the cleat bases 156 and to flow through the openings 156O through the rim to thereby permanently engage the cleats 150 with the outsole material 310. Note, for example, area 312 in FIG. 3H (a partial cut-away view of a portion of an outsole component 104*b*), which shows the outsole material 310 extending around the perimeter or rim of the cleat base 156 and through the openings 156O. The flowable outsole material 310 introduced during this step may blend with and form a continuous layer of material with the outsole material 310 introduced earlier (e.g., during the step of FIG. 3C). In this manner, a single, continuous layer of outsole material 310 completely covers and extends through the perimeter openings 156O of the cleat base 156. The outsole material 310 extending through the openings 156O and the surrounding/embedding of the raised areas 156N of the cleat base 156 into the outsole material 310 attach the cleat 150 to the outsole material 310 in an "in-molded" manner.

Figure 3G:
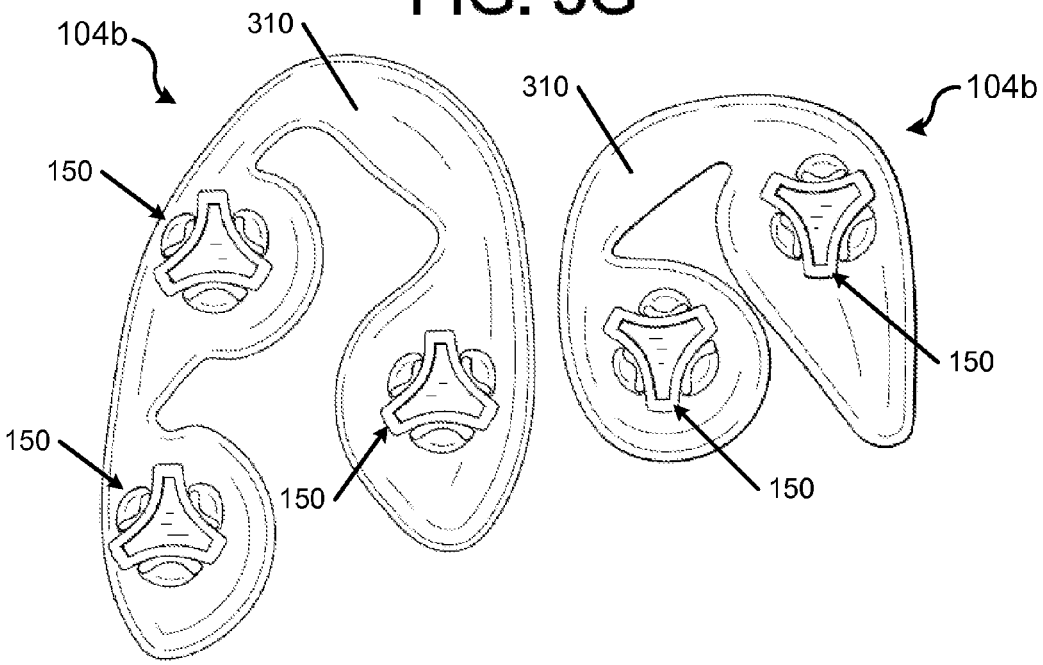
Figure 3H:
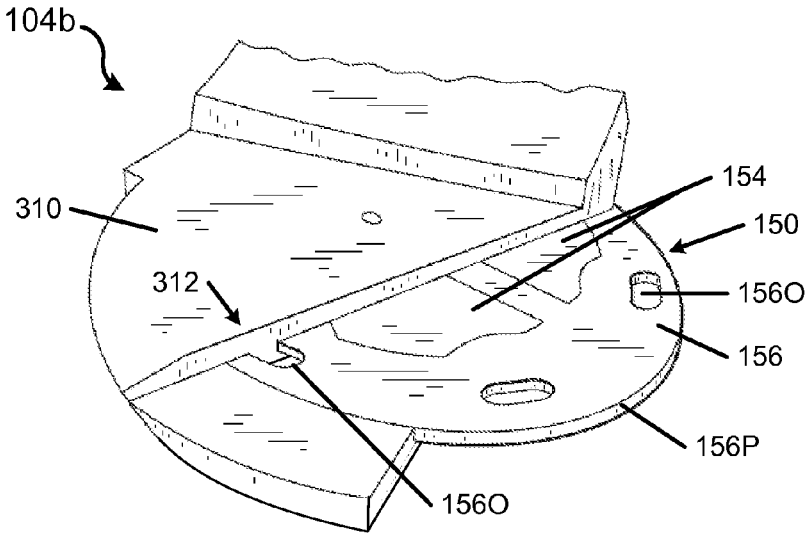

The outsole material 310 then may be finally cured and/or otherwise treated, and the combined outsole member 104*b* (including the outsole material 310 and the in-molded cleat components 150) may be removed from the mold 300 (e.g., as shown by FIG. 3G (for improved clarity, the optional fraction enhancing nubs 152 are not shown in FIG. 3G)). The curing or other post-molding treatments may be performed while the combined outsole member 104*b* is located within the mold 300 and/or after it is removed from the mold 300. The combined outsole member 104*b* further may be engaged with a midsole component 104*a* and/or otherwise engaged with an upper 102 or other structure to form an article of footwear (e.g., golf shoe 100).

The material of the cleat receptacles 304B helps prevent the materials of the cleat structures 150 (e.g., the cleat component 154 and/or the cleat base 156) from melting and/or otherwise deforming under the timing, heat, and/or pressure conditions used for molding the outsole material 310 into the desired configuration. As noted above, the materials at the surface of the cleat receptacles 304B have a lower thermal conductivity, and thus heat us less rapidly, than the material of the molding surfaces 304A of the mold cavities 304. This slowing of the heat transfer at the cleat receptacle areas 304B helps keep the cleat structures 150 sufficiently cool during the molding process (and optionally also during any curing and/or post-molding processes) to prevent melting and/or deformation of the cleat structure 150.

As one more specific example, the TPU material of the example cleat component 154 mentioned above may have a melting point of about 170° C., but under the temperature and pressure conditions used during formation of the base outsole component 104*b* (e.g., about 150° C. and elevated pressure), this TPU may begin to deform or melt at temperatures as low as about 90° C. The cleat receptacles 304B help keep the temperature around the cleats 150 somewhat lower during the outsole molding process (because the receptacle surfaces 304B heat up more slowly) to decrease the likelihood of the TPU melting or deforming during the molding process.

Many variations may be made from the specific molding processes described above without departing from this invention. For example, if desired, the cleat structures 150 could be set in the cleat receptacles 304B before any moldable outsole material 310 is introduced into the mold cavity 304, and/or the moldable outsole material 310 may be introduced in a single, molding step. This option, however, may require the use of some type of support within the mold cavity 304 (e.g., retractable pins) to hold the cleat structures 150 in the proper position while the moldable material 310 is being introduced (e.g., so that the flowing moldable material 310 does not tilt, knock askew, or otherwise affect positioning of the cleat structures 150). Such support structures also may be used in the processes of FIGS. 3A-3F, if necessary or desired.

Additionally, while the discussion of the mold structures and molding methods above relate primarily to production of cleated sole structures, features of these aspects of the invention may be applied to in-molding components other than cleats and/or footwear outsole components. Rather, aspects of this invention may be applied to molding any types of articles with in-molded components, and particularly to molding articles in which the base component to be molded must be processed under temperature, pressure, and/or timing conditions that could result in melting, deformation, and/or other types of damage to the in-molded component(s).

Figure 4A:
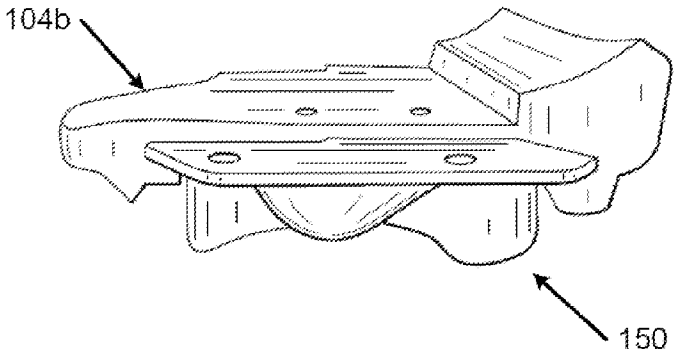
FIGS. 4A and 4B illustrate cut-away and sectional views, respectively of a cleat and sole construction in accordance with one example of this invention.
Figure 4B:
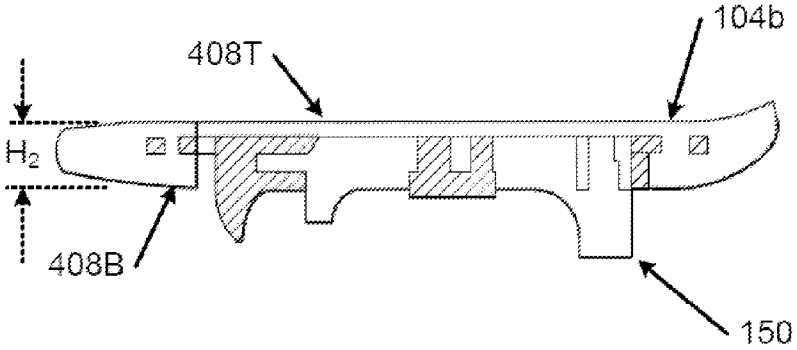

FIGS. 4A-4D and 4B illustrate further advantages potentially available in cleats and cleated sole structures in accordance with at least some examples of this invention. FIGS. 4A and 4B illustrate a partial cut-away perspective view and a cross sectional view, respectively, of a golf cleat element 150 in-molded with an outsole component 104*b* in accordance with at least some examples of this invention. As evident from these figures, the in-molded golf cleat element 150 does not require a known removable cleat element that includes a turnbuckle type connection system for releasably connecting the cleat element with corresponding connection structures provided in (e.g., engaged with) the outsole element. In addition to the added expense and manufacturing issues involved in incorporating these additional removable connection structures into a golf shoe, turnbuckle connection systems with this type of removable cleat and the connection structures therefore provided with the outsole project upward toward the wearer's foot. In some known releasable golf cleat element connections of this type, the height of the outsole component from the bottom surface to the top surface at and around the cleat engagement area is relatively high (e.g., typically at least about 8 mm) to accommodate the additional turnbuckle engagement structures needed in the outsole.

These known turnbuckle connection system structures also are relatively hard and stiff in order to prevent deformation and to assure a reliable connection between the cleat and the sole structure. Therefore, the turnbuckle connection system structures may apply significant pressure points and discomfort to the wearer's foot (particularly in view of the distances walked while playing a round of golf). Footwear manufacturers attempt to moderate the feel of these types of cleats either by adding significant midsole foam (or other material) over the cleat areas or by covering the cleat areas with a rigid moderator plate (in an effort to disperse the load over a larger area of the foot). These features increase the overall height of the sole structure and/or reduce flexibility and/or natural feel of the shoe.

The cleat and sole structures in accordance with at least some examples of this invention, on the other hand, as shown in FIGS. 4A and 4B, avoid some of these issues with the known cleats. As described above, by using the in-molded connection/attachment features, the overall bottom or interior base surface of cleats 150 in accordance with at least some examples of this invention are planar, substantially planar, and/or smoothly contoured. Additionally, the cleats 150 (and particularly the outer perimeter or rim area of the cleat base 156) may be made from materials that allows the cleat bottom or base surface to flex under an apply load (e.g., to better conform to the applied load shape). These features help avoid or reduce application of point load forces to the bottom plantar surface of the wearer's foot and help avoid or reduce the need for moderator plates and/or quite thick midsole material and midsole height to moderate the feel of the cleat 150. This flexibility likewise may enable the cleat base to flex as force is placed on the overall sole component, which may help the cleat to bend with the rubber or other material of the sole component rather than remaining stiff and unbent and pulling away from the material of the sole component (thereby tearing or breaking the rubber or other material holding the sole to the cleat). Sole structures in accordance with at least some examples of this invention also may have a reduced weight due to the reduced amount(s) of outsole and/or midsole material.

Additionally, the in-molded attachment features of cleats 150 in accordance with at least some examples of this invention avoid the need for turnbuckle, threaded, or other releasable cleat attachment features. This also helps avoid the point load features described above. Also, as illustrated in FIG. 4B, this feature allows the overall height $H_2$ of the outsole component 104*b* from the bottom surface 408B to the top surface 408T at and around the cleat engagement area to be made lower. The base outsole component thickness $H_2$ at and around the cleat engagement area may be made to be less than 7 mm (exclusive of the height of any raised nubs or other traction elements integrally formed in the outsole), and in some examples, less than 5 mm. In the illustrated example structure of FIG. 4B, the base outsole component thickness $H_2$ (exclusive of the height of any raised nubs or other traction elements integrally formed in the outsole) is about 4 mm. Therefore, the overall sole structure 104 of articles of footwear according to at least some examples and aspects of this invention may be made with a smaller overall height, a lower profile, and a more flexible construction. Aspects of sole structures in accordance with at least some examples of this invention may allow production of a more natural motion golf shoe (or other cleated shoe) construction.

As some additional potential advantages, the in-molding procedures for making the cleat structure 150 and/or the outsole component 104*b* may avoid the need to use primers, cements, or adhesives (or other chemicals, e.g., to engage the cleat component 154 with the cleat base 156 and/or to engage the cleat 150 with the base outsole material 104*b*). Thus, easier, cost-effective, and more environmentally friendly production processes may be used (as compared with processes that use of primers, adhesives, and/or cements). Alternatively, if desired, the in-molding processes described above could be used along with use of at least some amount of primers, adhesive, or cements (optionally, however, a reduced amount as compared to conventional processes, e.g., to better hold the parts in place at least during the initial phases of the production processes).

III. Conclusion

The present invention is disclosed above and in the accompanying drawings with reference to a variety of embodiments. The purpose served by the disclosure, however, is to provide examples of the various features and concepts related to the invention, not to limit the scope of the invention. Those skilled in the art will understand that the structures, options, and/or alternatives for the cleat structures, sole structures, footwear structures, molds, and/or molding methods described herein, including the features of the various different embodiments of the invention, may be used in any desired combinations, subcombinations, and the like, without departing from the invention. Those skilled in the relevant art also will recognize that numerous variations and modifications may be made to the embodiments described above without departing from the scope of the present invention, as defined by the appended claims.

What is claimed is:

1. A cleat, comprising:

a cleat component made from a first material, wherein the cleat component includes: (a) a first leg, wherein the first leg includes a first anchor post extending from an underside of the first leg toward a base surface of the cleat component, (b) a second leg, wherein the second leg includes a second anchor post extending from an underside of the second leg toward the base surface of the cleat component, (c) a third leg, wherein the third leg includes a third anchor post extending from an underside of the third leg toward the base surface of the cleat component, and (d) a central opening; and a cleat base engaged with the cleat component at the first, second, and third anchor posts of the cleat component, wherein the cleat base is made from a second material that is different from the first material, wherein a portion of the cleat base extends to and is exposed at an outer surface of the cleat through the central opening, and wherein an outer perimeter of the cleat base forms an outer perimeter of the cleat.

2. A cleat according to claim 1, wherein the cleat base includes a set of perimeter openings located adjacent the outer perimeter of the cleat base.

3. A cleat according to claim 2, wherein a base surface of the cleat is located inside the outer perimeter, wherein at least 95% of an area of the base surface of the cleat comprises the base surface of the cleat component, a base surface of the cleat base, and the set of perimeter openings, and wherein at least 95% of a combined surface area of the base surfaces of the cleat component and the cleat base is planar, substantially planar, or smoothly curved.

4. A cleat according to claim 1, wherein the portion of the cleat base exposed at the outer surface of the cleat through the central opening is surrounded by the first material of the cleat component.

5. A cleat according to claim 1, wherein the outer perimeter of the cleat base surrounds a single cleat, wherein a base surface of the cleat is located inside the outer perimeter, wherein at least 90% of an area of the base surface of the cleat inside the outer perimeter comprises the base surface of the cleat component and a base surface of the cleat base, and wherein at least 95% of a combined surface area of the base surfaces of the cleat component and the cleat base is planar, substantially planar, or smoothly curved.

6. A cleat according to claim 5, wherein at least 98% of the combined surface area of the base surfaces of the cleat component and the cleat base is planar, substantially planar, or smoothly curved.

7. A cleat according to claim 1, wherein the first material is softer than the second material.

8. A cleat according to claim 1, wherein the first material is a thermoplastic polyurethane material and the second material is a nylon material.

9. A cleat according to claim 1, wherein an exterior surface of the cleat base includes one or more traction enhancing structures.

10. A cleat according to claim 1, wherein the cleat does not include a threaded connector structure or a turnbuckle connector structure.

11. A cleat according to claim 1, wherein an exterior surface of the cleat base includes one or more traction enhancing structures located between each adjacent pair of legs of the cleat component.

12. A cleat according to claim 1, wherein an exterior surface of the cleat base includes a first fin element between the first and second legs, a second fin element between the second and third legs, and a third fin element between the first and third legs.

13. A cleat according to claim 1, wherein the cleat component includes a first ridge extending between the first and second legs, a second ridge extending between the second and third legs, and a third ridge extending between the first and third legs.

14. A cleat, comprising:

a cleat component made from a first material, wherein the cleat component includes: (a) a first leg, (b) a second leg, (c) a third leg, (d) a first ridge extending between the first and second legs, (e) a second ridge extending between the second and third legs, (f) a third ridge extending between the first and third legs, and (g) a central opening; and a cleat base engaged with the cleat component such that a first portion of the cleat base at least partially surrounds the first ridge, a second portion of the cleat base at least partially surrounds the second ridge, and a third portion of the cleat base at least partially surrounds the third ridge, wherein the cleat base is made from a second material that is different from the first material, wherein a portion of the cleat base extends to and is exposed at an outer surface of the cleat through the central opening, and wherein an outer perimeter of the cleat base forms an outer perimeter of the cleat.

15. A cleat according to claim 14, wherein an exterior surface of the cleat base over the first portion of the cleat base includes a first fin element, wherein the exterior surface of the cleat base over the second portion of the cleat base includes a second fin element, and wherein the exterior surface of the cleat base over the third portion of the cleat base includes a third fin element.

16. A cleat according to claim 14, wherein the first ridge includes a first opening defined therethrough, wherein the second ridge includes a second opening defined therethrough, wherein the third ridge includes a third opening defined therethrough, wherein the first portion of the cleat base extends through the first opening, wherein the second portion of the cleat base extends through the second opening, and wherein the third portion of the cleat base extends through the third opening.

17. A cleat according to claim 14, wherein the cleat base includes a set of perimeter openings located adjacent the outer perimeter of the cleat base.

18. A cleat according to claim 14, wherein a base surface of the cleat is located inside the outer perimeter, wherein at least 95% of an area of the base surface of the cleat comprises a base surface of the cleat component, a base surface of the cleat base, and the set of perimeter openings, and wherein at least 95% of a combined surface area of the base surfaces of the cleat component and the cleat base is planar, substantially planar, or smoothly curved.

19. A cleat according to claim 14, wherein the portion of the cleat base exposed at the outer surface of the cleat through the central opening is surrounded by the first material of the cleat component.

20. A cleat according to claim 14, wherein the outer perimeter of the cleat base surrounds a single cleat, wherein a base surface of the cleat is located inside the outer perimeter, wherein at least 90% of an area of the base surface of the cleat inside the outer perimeter comprises a base surface of the cleat component and a base surface of the cleat base, and wherein at least 95% of a combined surface area of the base surfaces of the cleat component and the cleat base is planar, substantially planar, or smoothly curved.

21. A cleat according to claim 20, wherein at least 98% of the combined surface area of the base surfaces of the cleat component and the cleat base is planar, substantially planar, or smoothly curved.

22. A cleat according to claim 14, wherein the first material is softer than the second material.

23. A cleat according to claim 14, wherein the first material is a thermoplastic polyurethane material and the second material is a nylon material.

24. A cleat according to claim 14, wherein an exterior surface of the cleat base includes one or more traction enhancing structures.

25. A cleat according to claim 14, wherein the cleat does not include a threaded connector structure or a turnbuckle connector structure.

26. A cleat, comprising:

a cleat base including a first surface, a second surface opposite the first surface, and an outer perimeter, wherein the cleat base is made from a first material, and wherein the cleat base includes: (a) a set of perimeter openings extending from the first surface to the second surface and located adjacent the outer perimeter and (b) a first inner opening located inside the set of perimeter openings; and a cleat component extending through the cleat base at the first inner opening, wherein the cleat component is made from a second material that is different from the first material, wherein a central portion of the cleat component includes a cleat component opening defined therethrough, and wherein the cleat component further includes: (a) a first surface that includes one or more traction enhancing structures and (b) a second surface opposite the first surface, wherein a base surface of the cleat is located inside the outer perimeter; wherein at least 95% of an area of the base surface of the cleat comprises the second surface of the cleat base, the second surface of the cleat component, and the set of perimeter openings; wherein a portion of the first material of the cleat base extends into and is exposed at the first surface of the cleat component through the cleat component opening; and wherein at least 95% of a combined surface area of the second surfaces of the cleat base and the cleat component is planar, substantially planar, or smoothly curved.

27. A cleat according to claim 26, wherein the portion of the first material exposed through the cleat component opening is surrounded by the second material of the cleat component.

28. A cleat according to claim 26, wherein at least 98% of the combined surface area of the second surfaces of the cleat base and the cleat component is planar, substantially planar, or smoothly curved.

29. A cleat according to claim 26, wherein the cleat does not include a threaded connector structure or a turnbuckle connector structure.

30. A cleat according to claim 26, wherein the first surface of the cleat component includes three traction legs as the traction enhancing structures, and wherein the first surface of the cleat base includes traction enhancing structures located between the traction legs of the cleat component.

* * * * *